US007027762B2

(12) United States Patent
Omata et al.

(10) Patent No.: US 7,027,762 B2
(45) Date of Patent: Apr. 11, 2006

(54) IMAGE FORMING APPARATUS OPERABLE IN A DUPLEX PRINT MODE

(75) Inventors: Yasukuni Omata, Kanagawa (JP); Hideaki Mochimaru, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 20 days.

(21) Appl. No.: 10/861,407

(22) Filed: Jun. 7, 2004

(65) Prior Publication Data

US 2004/0223793 A1 Nov. 11, 2004

Related U.S. Application Data

(63) Continuation of application No. 10/310,892, filed on Dec. 6, 2002.

(30) Foreign Application Priority Data

Dec. 7, 2001 (JP) ..... 2001-374541
Nov. 6, 2002 (JP) ..... 2002-322502

(51) Int. Cl.
*G03G 15/20* (2006.01)

(52) U.S. Cl. ..... 399/309; 399/120; 399/227; 399/262; 399/107

(58) Field of Classification Search ..... 399/111, 399/119, 120, 226, 227, 262, 405, 309, 107
See application file for complete search history.

(56) References Cited

U.S. PATENT DOCUMENTS 6,002,898 A * 12/1999 Yokomori et al. ..... 399/119
6,584,295 B1 6/2003 Omata et al.

FOREIGN PATENT DOCUMENTS

JP 8-160703 6/1996

* cited by examiner

*Primary Examiner*—Hoang Ngo
(74) *Attorney, Agent, or Firm*—Oblon, Spivak, McClelland, Maier & Neustadt, P.C.

(57) ABSTRACT

An image forming apparatus capable of forming images on both sides of a recording medium of the present invention includes a first image carrier on which a toner image to be formed, and a second image carrier to which the toner image is transferred from the first image carrier. The toner image transferred from the image carrier to the second image carrier is transferred to one side of the recording medium while a toner image is transferred from the first image carrier to the other side of the recording medium. After the toner image has been transferred from the first image carrier to the second image carrier, the running condition of the second image carrier is varied.

24 Claims, 28 Drawing Sheets

EMBODIMENT

IMAGE FORMING APPARATUS OPERABLE IN A DUPLEX PRINT MODE

BACKGROUND OF THE INVENTION

1. Field of the Invention

The present invention relates to a copier, printer, facsimile apparatus or similar image forming apparatus operable in a duplex print mode for printing images on both sides of a sheet or recording medium.

2. Description of the Background Art

It is a common practice with an image forming apparatus operable in a duplex print mode to transfer a toner image from an image carrier to one surface of a sheet, fix the toner image, turn the sheet via, e.g., a turn path, and again feed the sheet to form another toner image on the other side of the sheet. The problem with this type of apparatus is that the sheet cannot be reliably conveyed due to the switching of the sheet conveying direction and the curl of the sheet ascribable to the fixation of the toner image on one side of the sheet.

In light of the above, Japanese Patent Laid-Open Publication No. 1-209470 discloses an image forming apparatus including a first and a second image carrier for transferring toner images to both sides of a sheet and then fixing them at the same time. More specifically, in the apparatus taught in this document, a first image formed on a photoconductive element is transferred to an image transfer belt by first image transferring means. Subsequently, a second toner image formed on the photoconductive element is transferred to one side of a sheet. Thereafter, the first image is transferred from the belt to the other side of the sheet by second image transferring means. The sheet carrying the toner images on both sides thereof is conveyed to a fixing unit.

However, the procedure taught in the above document is not practicable without causing the image transfer belt to make two turns. More specifically, the second image begins to be formed only after the image transfer belt has made one full turn, resulting in lower productivity in the duplex print mode. This is particularly true when full-color images are formed on both sides of a sheet.

Technologies relating to the present invention are also disclosed in, e.g., Japanese Patent Laid-Open Publication No. 8-160703.

SUMMARY OF THE INVENTION

It is an object of the present invention to provide an image forming apparatus capable of executing a full-color duplex print mode without lowering productivity.

An image forming apparatus capable of forming images on both sides of a recording medium of the present invention includes a first image carrier on which a toner image to be formed, and a second image carrier to which the toner image is transferred from the first image carrier. The toner image transferred from the image carrier to the second image carrier is transferred to one side of the recording medium while a toner image is transferred from the first image carrier to the other side of the recording medium. After the toner image has been transferred from the first image carrier to the second image carrier, the running condition of the second image carrier is varied.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
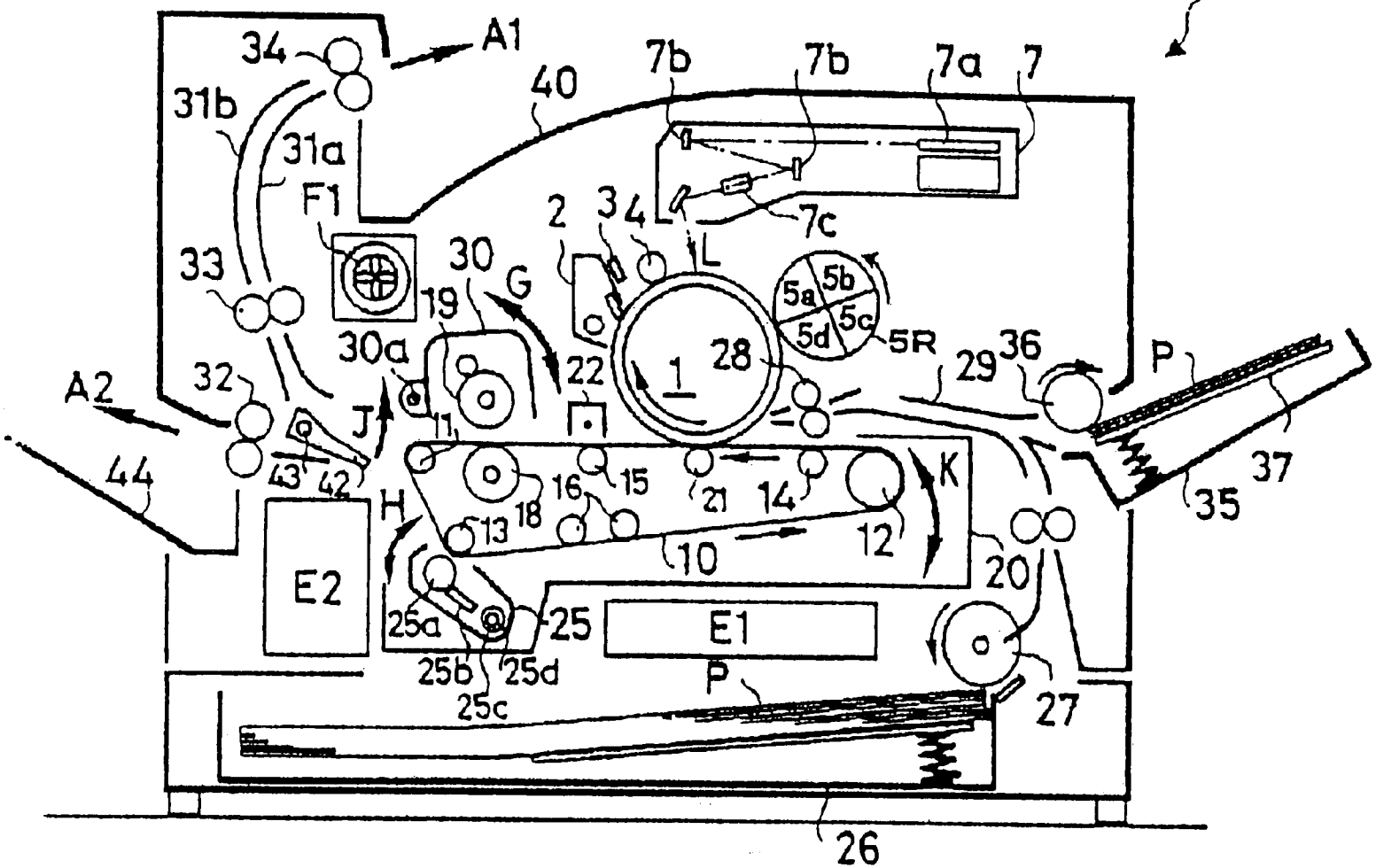
FIG. 1 is a section showing an image forming apparatus embodying the present invention.

Referring to FIG. 1 of the drawings, an image forming apparatus embodying the present invention is shown and implemented as a printer by way of example. As shown, the printer, generally 100, includes a photoconductive drum or first image carrier 1 positioned at substantially the center of the printer body. Arranged around the drum 1 are a drum cleaner 2, a discharger 3, a charger 4, and a revolver type developing unit (revolver hereinafter) 5R. An optical writing unit 7 is positioned above the drum 1 and scans the surface of the drum 1 with a laser beam L at a position between the charger 4 and the revolver 5R.

A belt unit 20 is arranged below the drum 1 and includes an intermediate image transfer belt or second image carrier 10. In the illustrative embodiment, the intermediate image transfer belt (Simply belt hereinafter) 10 is angularly movable into or out of contact with the drum 1 in a direction indicated by a double-headed arrow K in FIG. 1. When image formation is not under way, the belt 10 is spaced from the drum 1 so as not to curl or otherwise deform or adversely effect the drum 1. The belt 10 should preferably be releasable from the drum 1 in the event of jam processing as well.

The belt 10 is passed over rollers 11, 12 and 13. A moving mechanism, which will be described later, causes the belt 10 to angularly move about the roller 11 into or out of contact with the drum 1 in the direction K. The belt 10 is heat-resistant, coated with PFA (perfluoroalcoxy), and provided with resistance of $10^5$ Ω.cm to $10^{12}$ Ω.cm that allows toner to be transferred to the belt 10. In the illustrative embodiment, a mark, not shown, is provided on the belt 10 for controlling the system. In the event of power-up, the timing mark on the belt 10 is sensed to bring the belt 10 to a preselected reference or initial position.

Back rollers 14 and 15, cooling means 16, a fixing roller 18 and first image transferring means 21 are arranged inside of the loop of the belt 10. The fixing roller 18 accommodates a heater or similar heat source and fixes a toner image carried on a sheet. The first image transferring means 21 faces the drum 1 with the intermediary of the belt 10 for transferring a toner image formed on the drum 1 to the belt 10 or a sheet. The belt 10 is driven by a stepping motor 53 (see FIG. 11) via the drive roller 11. The stepping motor 53 is independent of a motor that drives the drum 1 and other rotary members.

Second image transferring means 22, a fixing device 22 and a belt cleaner 25 are positioned outside of the loop of the belt 10. The fixing device 30 includes a fixing roller 19 also accommodating a heater or similar heat source and fixes a toner image carried on a sheet. A mechanism, not shown, causes the fixing device 30 to angularly movable about a fulcrum 30*a* into or out of contact with the fixing roller 18 with the intermediary of the belt 10 (and sheet) in a direction indicated by a double-headed arrow G.

The belt cleaner 25 assigned to the belt 10 includes a cleaning roller 25*a*, a blade 25*b* and toner conveying means 25*c* and removes toner left on the belt 10 after image transfer. The toner conveying means 25*c* conveys the toner collected in the belt cleaner 25 to a container not shown. The belt cleaner 25 is angularly movable about a fulcrum 25*d* in a direction indicated by a double-headed arrow H. A mechanism, not shown, causes the belt cleaner 25 to move into or out of contact with the belt 10 in the direction H.

The drum 1, drum cleaner 2, charger 4 and revolver 5R may be constructed into a single process cartridge replaceable when its life ends.

A sheet cassette 26 is positioned in the lower portion of the printer body and can be pulled out to the front in the direction perpendicular to the sheet surface of FIG. 1. Sheets or recording media P are stacked on the cassette 26. A pickup roller 27 is positioned above the right end, as viewed in FIG. 1, of the sheet cassette 26. A manual sheet feed tray 35 is mounted on the right side, as viewed in FIG. 1, of the printer body. The manual sheet feed tray 35 includes a bottom plate 37 loaded with sheets P and constantly biased toward a pickup roller 36.

A registration roller pair 28 is located at the right-hand side, as viewed in FIG. 1, of the drum 1. A guide 29 guides the sheet P fed from either one of the sheet cassette 26 and manual sheet feeder 35 toward the registration roller pair 28. An electric unit E1 and a control unit E2 are positioned above the sheet cassette 26.

A path selector 42 is positioned at the left-hand side, as viewed in FIG. 1, of the fixing device 30. The path selector 42 is pivotable about a fulcrum 43 to steer the sheet P coming out of the belt unit 20 to either one of a stack portion 40 positioned on the top of the printer body and a print tray 44 mounted on the side of the printer body. More specifically, a solenoid or similar actuator, not shown, moves the path selector 42 to a position shown in FIG. 1 for steering the sheet P toward the stack portion 40 or moves it in a direction indicated by an arrow J for steering the sheet P toward the print tray 44.

A roller pair 33 is positioned above the path selector 42 for conveying the sheet P while a roller pair 34 is positioned above the roller pair 33 for driving the sheet P to the stack portion 40. Guides 31*a* and 31*b* cooperate to guide the sheet P from the roller pair 33 to the roller pair 34. A roller pair 32 is positioned at the left-hand side, as viewed in FIG. 1, of the path selector 42 for driving the sheet P out of the printer body to the print tray 44.

The revolver 5R includes four developing sections 5*a* through 5*d* and is rotatable counterclockwise, as viewed in FIG. 1, to locate one of the developing sections 5*a* through 5*d* at a developing position. The developing sections 5*a* through 5*d* each store toner of a particular color so as to implement full-color development. For example, the developing sections 5*a* through 5*d* store yellow toner, magenta toner, cyan toner and black toner, respectively. In a monochromatic print mode, the developing section 5*d* is located at the developing position.

The operation of the illustrative embodiment will be described hereinafter. First, a duplex print mode for forming images on both sides of the sheet P will be described. As for a duplex print mode, a toner image formed first and a toner image formed next will be referred to as a first and a second toner image, respectively. Also, a first and a second side of the sheet to which the first and second toner images are transferred will be referred to as a first and a second side, respectively.

On the power-up of the printer 100, the belt or second image carrier 10 is brought to its reference position on the basis of the mark mentioned earlier. The printer 100 receives image data from a host machine, e.g., a computer. The writing unit 7 emits the laser beam L toward a polygonal mirror 7*a*, which is rotated by a motor, in accordance with the image data. The laser beam L is steered by the polygonal mirror 7*a* and incident to the surface of the drum 1, which has been uniformly charged by the charger 4, via a mirror 7*b*, an f-θ lens 7*c* and so forth. As a result, a latent image corresponding to the image data is electrostatically formed on the drum 1.

In a monochromatic print mode, the developing section 5*d* develops the latent image with the black toner for thereby producing a black toner image on the drum 1.

On the other hand, in a full-color print mode, the writing unit 7 first scans the charged surface of the drum 1 with the laser beam L in accordance with yellow image data, thereby forming a latent image. At this instant, the belt 10 is spaced from the drum 1. The developing section 5*a* located at the developing position develops the above latent image with yellow toner to thereby produce a yellow toner image. Subsequently, a magenta toner image is formed on the drum 1 over the yellow toner image. Likewise, a cyan toner image and a black toner image are sequentially formed on the drum 1 in this order over the composite toner image existing on the drum, completing a full-color toner image. The drum 1 makes four rotations for forming the full-color toner image. It is to be noted that the order of colors mentioned above is only illustrative.

The first image transferring means 21 transfers the toner image, which is monochromatic or full-color, from the drum 1 to the surface of the belt 10, which is running in synchronism with the rotation of the drum 1. After the image transfer, the drum cleaner 2 removes the toner left on the drum 1. Subsequently, the discharger 3 discharges the surface of the drum 1 for thereby preparing it for the next image forming cycle.

The belt 10, carrying the toner image or first toner image thereon, turns counterclockwise as viewed in FIG. 1. At this instant, the second image transferring means 22, fixing device 30 and belt cleaner 25 are maintained inoperative so as not to disturb the toner image carried on the belt 10. For this purpose, such process units 22, 30 and 25 may be released from the belt 10 or electric inputs thereto may be shut off.

After the entire first toner image has been transferred from the drum 1 to the belt 10, the belt 10 is released from the drum 10 and then turned in the reverse direction, i.e., clockwise in FIG. 1 to the reference position. The distance of movement of the belt 1 is controlled on the basis of the number of steps of the stepping motor or drive means. In the illustrative embodiment, the reverse movement of the belt 10 is effected at a speed two times as high as the speed of the forward movement or usual speed. On reaching the reference position, the belt 10 is again brought into contact with the belt 10 and then moved counterclockwise, i.e., in the forward direction.

A toner image to be transferred to the second side of one sheet P, i.e., a second toner image is formed on the drum 1 in the same manner as the first toner image. At this instant, the top sheet P on the sheet cassette 26 or the manual sheet feed tray 35 is paid out by the pickup roller 27 or 36, respectively, and conveyed to the nip between the registration rollers 28. The registration roller pair 28 conveys the sheet P to the nip between the drum 1 and the belt 10 at a timing that matches the position of the toner image and that of the sheet P. The first image transferring means 21 transfers the second toner image from the drum 1 to the second side of the sheet P.

While the toner or second toner image is being transferred from the drum 1 to the second side of the sheet P, the other side or first side of the sheet P moves together with the toner existing on the belt 10, i.e., with the first side contacting the first image. When the sheet P reaches the second image transferring means 22, the transferring means 22 transfers the toner from the belt 10 to the sheet P by being applied with a voltage.

The belt 10 in movement conveys the sheet P carrying the toner images on both sides thereof to a fixing position where the fixing device 30 is located. At this instant, the fixing device 30 is angularly moved to press the fixing roller 19 against the fixing roller 18 via the belt 10, so that the fixing rollers 18 and 19 cooperate to fix the toner images on both sides of the sheet P. In this manner, the toner images are fixed on the sheet P with the sheet P contacting the belt 10, so that the toner images are prevented from being disturbed. The sheet P coming out of the fixing device 30 is separated from the belt 10 at the position where the roller 11 is located. Subsequently, the path selector 42 steers the sheet P toward the stack portion 40 or the print tray 44.

As shown in FIG. 1, when the path selector 42 steers the sheet P toward the stack portion 40, the sheet P is laid on the stack portion 40 with its surface to which the toner image is directly transferred from the drum 1 facing downward. Therefore, to stack consecutive prints on the stack portion 40 in order of page, it suffices to form a toner image corresponding to the second page first, transfer it to the belt 10, form a toner image corresponding to the second page, and then directly transfer the toner image of the second page to the sheet P. In this respect, the first and second images correspond to the second and first pages, respectively. This is also true with the third page and successive pages. The crux is that when an image is present on an even page, it is formed first and transferred to the belt 10, and then the image of an odd page preceding the even page is formed and directly transferred from the drum 1 to the sheet P.

On the other hand, when the path selector 42 steers the sheet P toward the print tray 44, the sheet P is laid on the print tray 44 with its surface to which the toner image is directly transferred from the drum 1 facing upward. Therefore, when consecutive prints should be stacked on the print tray 44 in order of page, the first and second images correspond to the first and second pages, respectively. This is also true with the third page and successive pages. The crux is that when an image is present on an odd page, it is formed first and transferred to the belt 10, and then the image of an even page following the odd page is formed and directly transferred from the drum 1 to the sheet P.

Usually, a reversed image or mirror image is formed on the drum 1 and then directly transferred from the drum 1 to the sheet P as a non-reversed image. However, as for image transfer from the belt 10 to the sheet P, a mirror image formed on the drum 1 would also be a mirror image on the sheet P. In light of this, the writing unit 7 scans the drum 7 such that an image to be transferred from the belt 10 to the sheet P is a non-reversed image on the drum 1 while an image to be directly transferred from the drum 1 to the sheet P is a mirror image on the drum 1. Such an image forming sequence for page arrangement can be implemented by a conventional technology using a memory for storing image data. Also, exposure that selectively forms a reversed image or a non-reversed image can be implemented by a conventional image processing technology.

After the image transfer from the belt 10 to the sheet P, the belt cleaner 10 is angularly moved to bring the cleaning roller 25*a* into contact with the belt 10 and cause the roller

25*a* to remove toner left on the belt 10. Subsequently, the blade 25*b* wipes off the toner deposited on the cleaning roller 25*a*. The toner collected by the blade 25*b* is conveyed to the previously mentioned container by the toner conveying means 25*c*.

The belt 10 moved away from the cleaning position is cooled off by the cooling means 16 that may use any conventional heat radiation scheme. For example, as for a scheme producing an air stream, it is preferable to cause air to flow after the image transfer from the belt 10 to the sheet P, thereby preventing the toner image carried on the belt 10 from being disturbed. Use may also be made of a heat pipe directly contacting the inner surface of the belt 10. In any case, a fan F1 discharges heat radiated from the belt 10 to the outside of the printer body.

A simplex print mode available with the illustrative embodiment for forming an image on one side of the sheet P will be described hereinafter. First, when the sheet or print P carrying an image on one side thereof, i.e., a simplex print should be driven out to the stack portion 40, the image transfer from the drum 1 to the belt 10 is not necessary, i.e., a monochromatic or a full-color toner image is directly transferred from the drum 1 to the sheet P. In this case, a reversed image or mirror image is formed on the drum 1 and then transferred to the sheet P as a non-reversed image.

More specifically, as shown in FIG. 1, the sheet P is conveyed to the nip between the drum 1 and the belt 10 in synchronism with the rotation of the drum 1. The first image transferring means 21 transfers a toner image formed on the drum 1 to one side or upper surface of the sheet P facing the drum 1. At this instant, the second image transferring means 22 does not operate. The sheet P with the toner image is conveyed by the belt 10 to the fixing device 30, separated from the belt 10, and then driven out to the stack portion 40 face down via the guides 31*a* and 31*b* and roller pair 32, as indicated by an arrow A1. Consequently, even when several pages of documents are dealt with, the first page being first, the resulting prints are stacked on the stack portion 40 in order of page.

Next, when the sheet or simplex print P should be driven out to the print tray 44, the toner image formed on the drum 1 is transferred to the belt 10 by the first image transferring means 21. After the transfer of the entire page, the belt 10 carrying the toner image is moved in the reverse direction, i.e., clockwise in FIG. 1 to the reference position. At this instant, the belt 10 is spaced from the drum 1. On reaching the reference position, the belt 10 is again brought into contact with the drum 1 and then turned in the forward direction, i.e., counterclockwise in FIG. 1. Subsequently, the second image transferring means 22 transfers the toner image from the belt 10 to the side or lower surface of the sheet P facing the belt 10. Again, even when several pages of documents are dealt with, the first page being first, the resulting prints are stacked on the print tray 44 in order of page.

Even when an image is to be formed on a thick sheet, OHP (OverHead Projector) film or similar relatively hard sheet in the simplex print mode, the sheet can be substantially linearly conveyed if the manual sheet tray 35 and print tray 44 are designated. Therefore, simplex prints are achievable in order of page even with relatively thick, rigid sheets without degrading conveyance.

As stated above, after the transfer of a toner image from the drum 1 to the belt 10, the illustrative embodiment moves the belt 10 in the reverse direction to the reference position and therefore does not have to wait until the belt 10 completes one full turn, thereby saving time. The reverse movement of the belt 10 is effective not only in the duplex print mode but also in the simplex print mode. Particularly, productivity is noticeably enhanced because the reverse movement of the belt 10 occurs at a speed two times as high as the speed of the forward movement. Stated another way, the illustrative embodiment improves productivity by varying the running condition of the belt or second image carrier 10.

Figure 2:
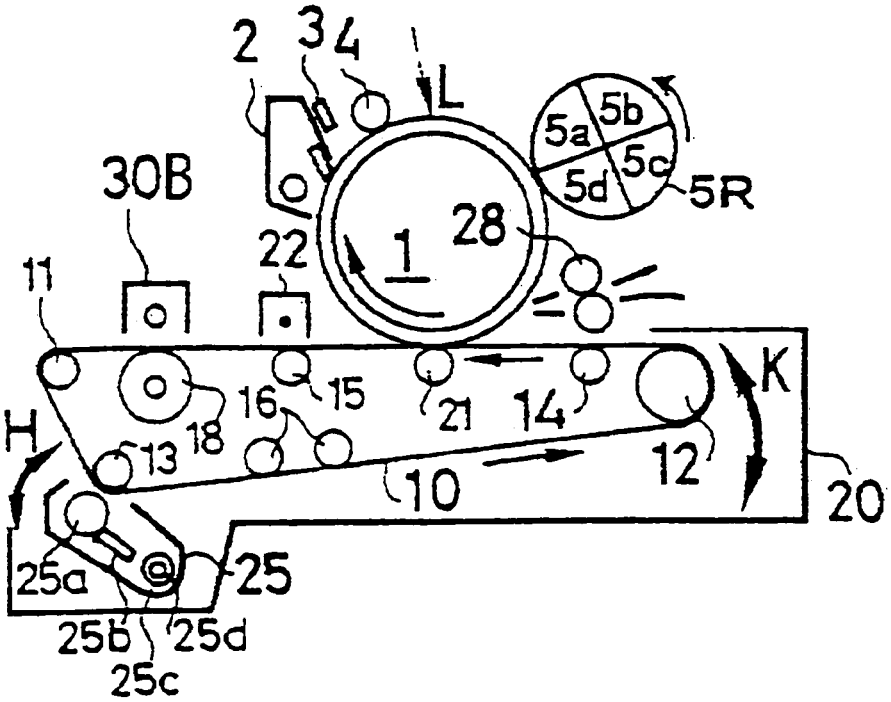
FIG. 2 is a section showing another specific configuration of an image forming section included in the illustrative embodiment.

FIG. 2 shows another specific configuration of the fixing device. As shown, the fixing device, labeled 30B, differs from the fixing device 30, FIG. 1, in that it does not contact the belt 10. The fixing device 30B fixes a toner image or toner images on the sheet with an infrared lamp, xenon lamp or similar lamp. The fixing device 30, which does not contact the belt 10, does not have to be angularly movable, but should only be fixed in place.

Figure 3:
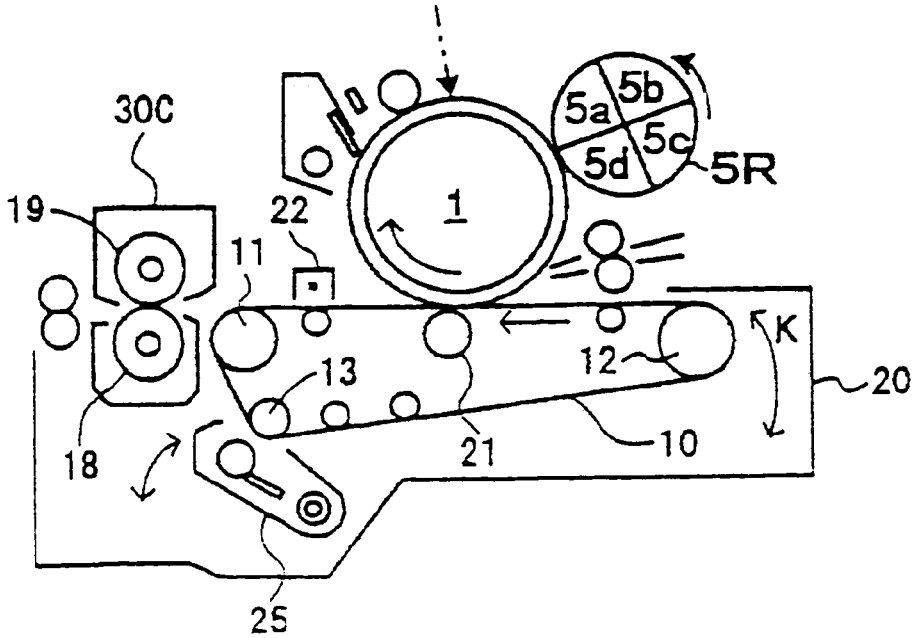
FIG. 3 is a section showing still another specific configuration of the image forming section.

FIG. 3 shows another specific configuration of the fixing device. As shown, the fixing device, labeled 30C is positioned outside of the loop of the belt 10 and includes the fixing rollers 18 and 19 each accommodating a respective heater. The fixing device 30C is also fixed in place and does not have to be moved into or out of contact with the belt 10.

Figure 4:
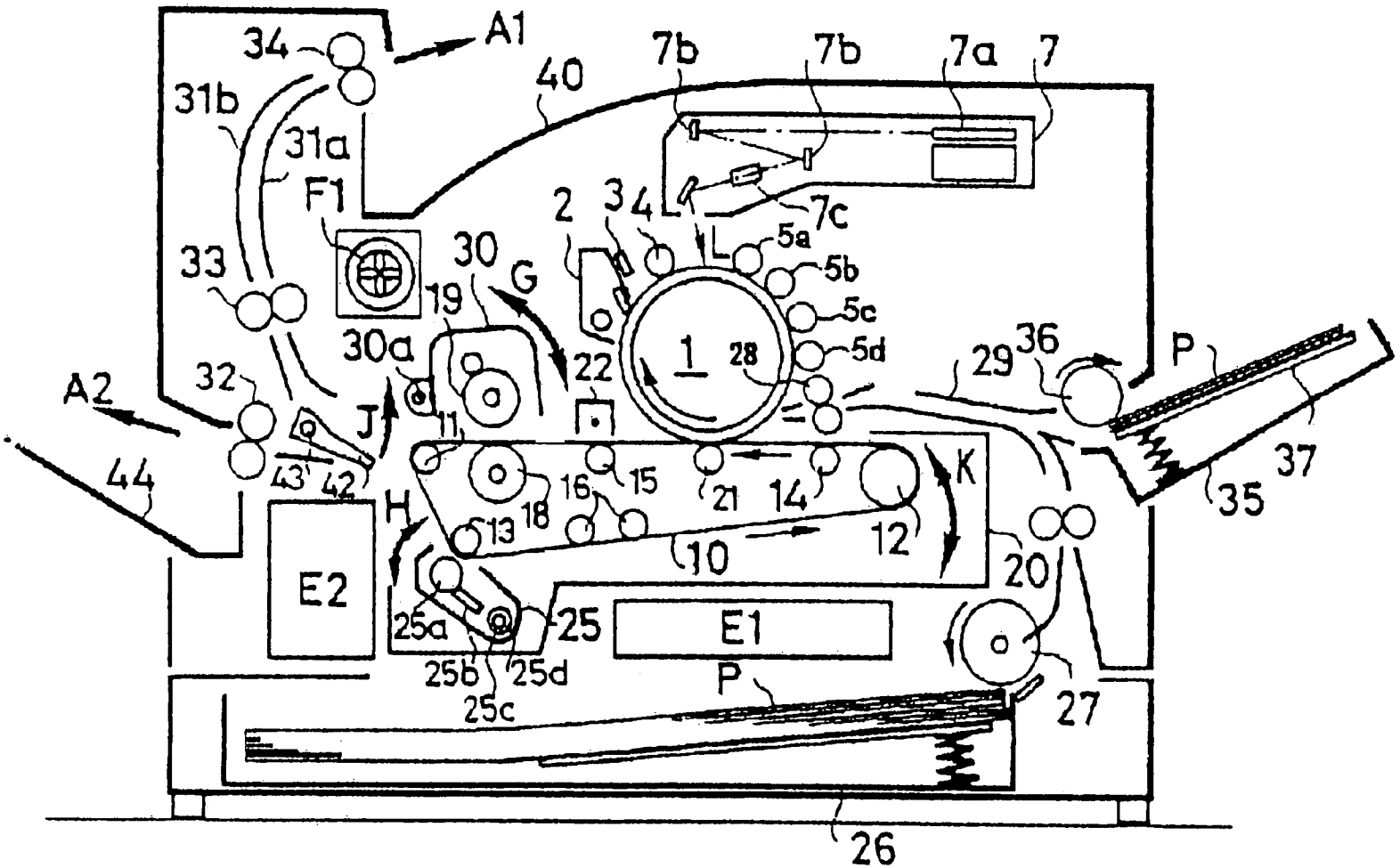
FIG. 4 is a section showing a modification of the illustrative embodiment.

FIG. 4 shows another specific configuration of the developing device. As shown, the developing device differs from the revolver 5R in that four developing units 5*a* through 5*d* each storing toner of a particular color are arranged around the drum 1. The developing device of FIG. 4 is similarly applicable to the specific configuration shown in FIG. 2 or 3.

Figure 5A:
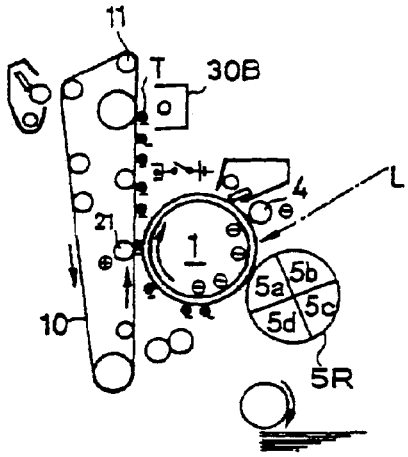
FIGS. 5A through 5F demonstrate a specific operation of the illustrative embodiment.
Figure 5B:
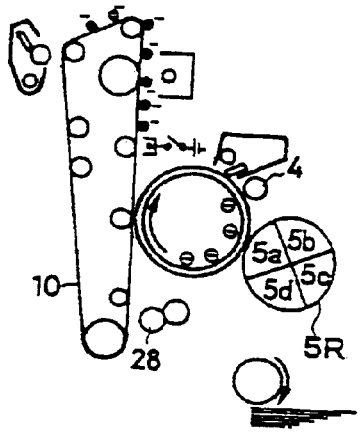
Figure 5C:
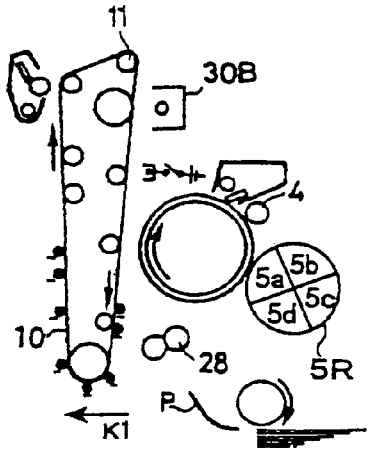
Figure 5D:
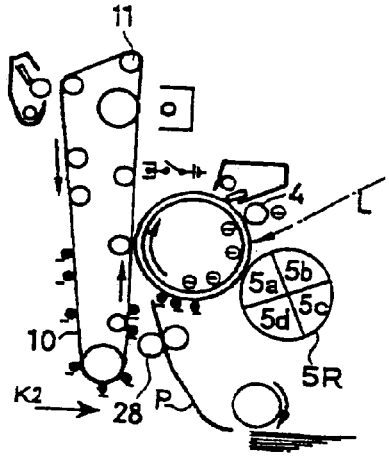
Figure 5E:
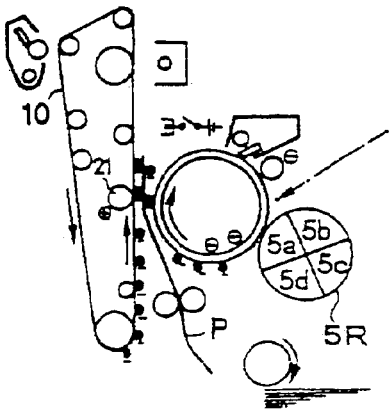

Reference will be made to FIGS. 5A through 5F for describing a specific image forming sequence that the illustrative embodiment effects in the duplex print mode, taking the configuration of FIG. 2 as an example. The belt 10 is shown as extending in the up-and-down direction for space reasons. In FIGS. 5A and 5E, while the drum 1 and belt 10 are shown as being spaced from each other, they are, in practice, held in contact with each other.

First, as shown in FIG. 5A, the charger 4 uniformly charges the surface of the drum 1 to negative polarity. The writing unit scans the charged surface of the drum 1 with the laser beam L to thereby form a latent image. The developing device 5 develops the latent image with negatively charged toner, which is represented by black dots in FIG. 5A, thereby producing a corresponding toner image. Subsequently, the first image transferring means 21, which is applied with a positive voltage, transfers the toner image from the drum 1 to the belt 10. This image transfer will be referred to as primary image transfer hereinafter.

As shown in FIG. 5B, after the primary image transfer, the belt 10 is brought to a stop. Subsequently, as shown in FIG. 5C, the belt 10 is released from the drum 1 in a direction K1 and then moved in the reverse direction or clockwise to the reference position at the previously stated speed.

As shown in FIG. 5D, a toner image or second image of negative polarity is formed on the drum 1 while the belt 10 is again moved into contact with the drum 1 in a direction K2 and then moved in the forward direction or counterclockwise. The sheet P is driven by the registration roller pair 28 at such a timing that the first and second images are accurately positioned on the sheet P.

As shown in FIG. 5E, the first image transferring means 21, which is applied with a positive voltage, transfers the second image of negative polarity from the drum 1 to the sheet P. This image transfer will be referred to as secondary image transfer. At this instant, the first side of the sheet P is overlaid on the first image carried on the belt 10.

Figure 5F:
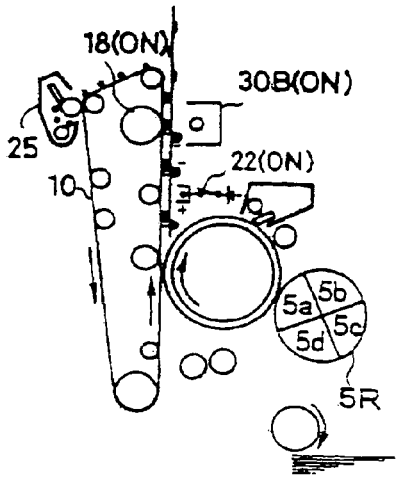

Finally, as shown in FIG. 5F, the second image transferring means 22, which is also applied with a positive voltage, transfers the first image of negative polarity from the belt 10 to the sheet P. This image transfer will be referred to as tertiary image transfer hereinafter. The belt 10 in movement conveys the sheet P carrying the first and second images thereon to the fixing position. The fixing means 18 and 30B are heated, or turned on, to fix the first and second images on the sheet P. At this instant, the belt cleaner 25 is pressed against the belt 10 for removing toner left on the belt 10. In the specific configuration shown in FIG. 3, the sheet P separated from the belt 10 is conveyed to the fixing position.

Another specific image forming procedure available with the illustrative embodiment will be described hereinafter with reference to FIGS. 6A through 6F. Briefly, in the sequence to be described, a single image transferring means transfers the toner image carried on the belt 10 and the toner image formed on the drum 1 to both sides of the sheet P at the same time. More specifically, a charger or polarity switching device inverts the polarity of the toner image carried on the belt 10, so that the toner image can be transferred to the sheet P at the same time as the toner image formed on the drum 1 by a single image transferring means. As for the rest of the construction, the procedure to be described is identical with the previous procedure.

The polarity of the toner image carried on the belt or second image carrier 10 may be inverted during either one of the forward movement and reverse movement of the belt 10. First, assume that the polarity is inverted while the belt 10 is in reverse movement. The specific procedure uses the non-contact type of fixing device 30B, FIG. 2, by way of example.

As shown in FIGS. 6A through 6F, a polarity switching device 50 is positioned downstream of the image transferring means 21 in the direction of forward movement of the belt 10, but upstream of the fixing device 30B. The belt 10 is also angularly movable in the direction K, FIGS. 1 through 4, into or out of contact with the drum 1. The polarity switching device 50 is also movable in accordance with the movement of the belt 10, so that the relative position of the former and latter does not change. The polarity switching device 50 is essentially identical with the second image transferring means 22 of the previous embodiment and may be implemented thereby so long as the relative position mentioned above does not change.

Figure 6A:
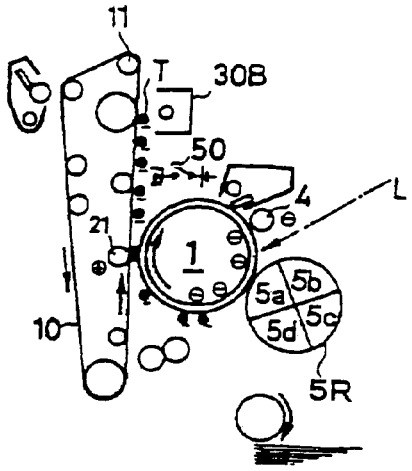
FIGS. 6A through 6F demonstrate another specific operation of the illustrative embodiment.
Figure 6B:
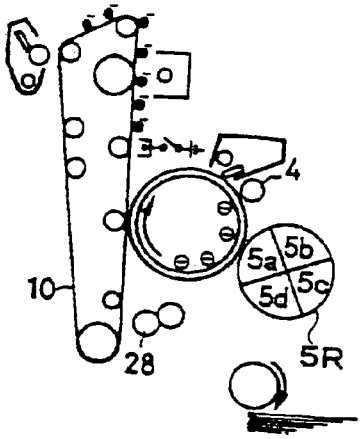
Figure 6C:
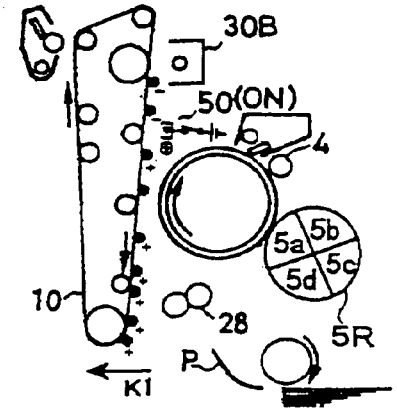
Figure 6D:
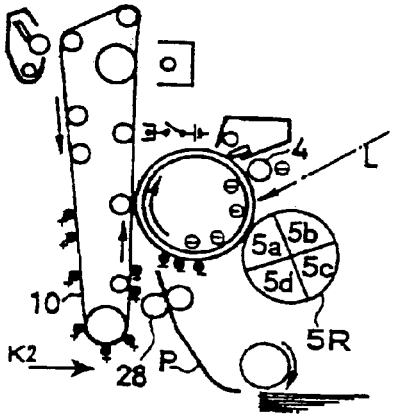
Figure 6E:
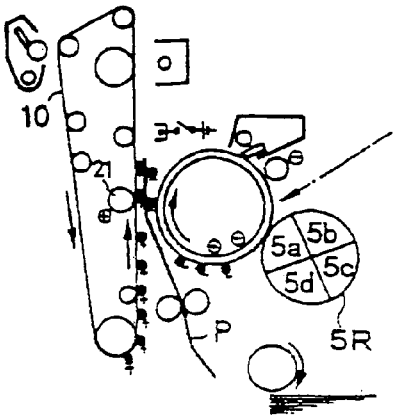

The procedure shown in FIGS. 6A through 6F differs from the procedure of FIGS. 5A through 5F in that it does not effect the tertiary image transfer. The belt 10 is shown as extending in the up-and-down direction for space reasons. In FIGS. 6A and 6E, while the drum 1 and belt 10 are shown as being spaced from each other, they are, in practice, held in contact with each other.

First, as shown in FIG. 6A, the charger 4 uniformly charges the surface of the drum 1 to negative polarity. The writing unit scans the charged surface of the drum 1 with the laser beam L to thereby form a latent image. The developing device 5 develops the latent image with negatively charged toner, which is represented by black dots in FIG. 6A, thereby producing a corresponding toner image. Subsequently, the image transferring means 21, which is applied with a positive voltage, transfers the toner image from the drum 1 to the belt 10 (primary image transfer).

As shown in FIG. 6B, after the primary image transfer, the belt 10 is brought to a stop. Subsequently, as shown in FIG. 6C, the belt 10 is released from the belt 10 and then moved in the reverse direction or clockwise to the reference position at the previously stated speed. At this instant, the polarity switching device 50 is applied with a positive voltage, or turned on, to switch the polarity of the toner image on the belt 10 from negative to positive.

As shown in FIG. 6D, a toner image or second image of negative polarity is formed on the drum 1 while the belt 10 is again moved into contact with the drum 1 and then turned in the forward direction or counterclockwise. The sheet P is driven by the registration roller pair 28 at such a timing that the first and second images are accurately positioned on the sheet P.

As shown in FIG. 6E, the image transferring means 21, which is applied with a positive voltage, transfers the toner image of negative polarity carried on the belt 10 and the second toner image of negative polarity formed on the drum 1 to the sheet P at the same time.

Figure 6F:
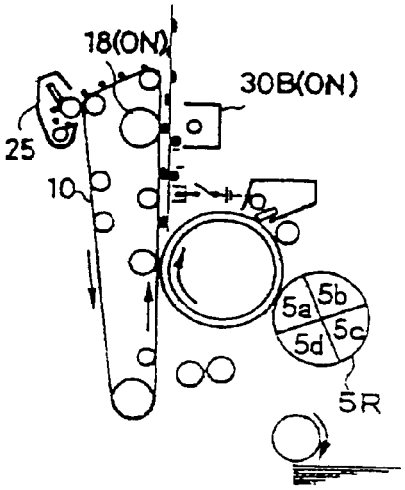

Finally, as shown in FIG. 6F, the belt 10 in movement conveys the sheet P carrying the first and second images thereon to the fixing position. The fixing means 18 and 30B are heated, or turned on, to fix the first and second images on the sheet P. At this instant, the belt cleaner 25 is pressed against the belt 10 for removing toner left on the belt 10. In the specific configuration shown in FIG. 3, the sheet P separated from the belt 10 is conveyed to the fixing position.

Next, how the polarity is inverted while the belt 10 is in forward movement will be described with reference to FIGS. 7A through 7F. Again, the polarity switching device 50 is positioned downstream of the image transferring means 21 in the direction of forward movement of the belt 10, but upstream of the fixing device 30B. Also, the polarity switching device 50 may be fixed in place, if desired.

Figure 7A:
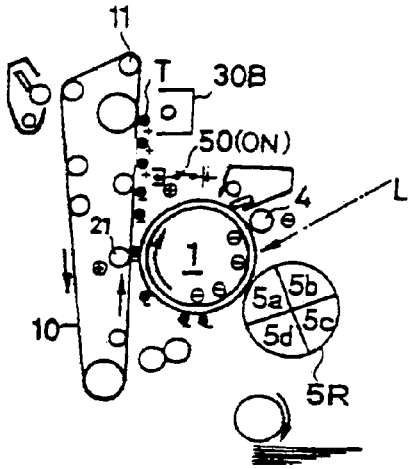
FIGS. 7A through 7F demonstrate still another specific operation of the illustrative embodiment.

First, as shown in FIG. 7A, the charger 4 uniformly charges the surface of the drum 1 to negative polarity. The writing unit scans the charged surface of the drum 1 with the laser beam L to thereby form a latent image. The developing device 5 develops the latent image with negatively charged toner, which is represented by black dots in FIG. 7A, thereby producing a corresponding toner image. Subsequently, the image transferring means 21, which is applied with a positive voltage, transfers the toner image from the drum 1 to the belt 10 (primary image transfer). While the belt 10 conveys the toner image forward, the polarity switching means 50 is applied with a positive voltage, or turned on, to switch the polarity of the toner image from negative to positive.

Figure 7B:
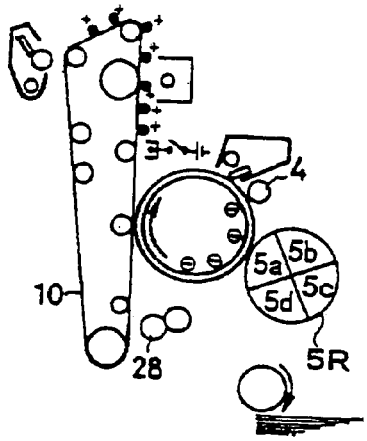

As shown in FIG. 7B, after the trailing edge of the toner image has moved away from the polarity switching device 50, the belt 10 is brought to a stop. As a result, the entire toner image carried on the belt 10 is inverted in polarity.

Figure 7C:
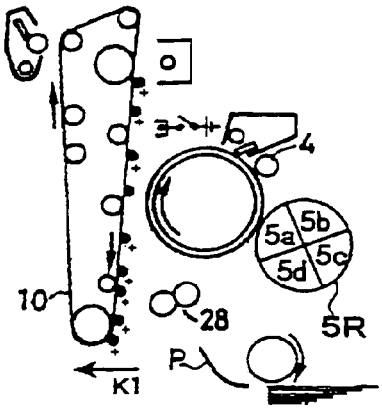

Subsequently, as shown in FIG. 7C, the belt 10 is released from the belt 10 and then reversed in the clockwise direction to the reference position at the previously stated speed. Because the polarity of the toner image on the belt 10 has already been switched in polarity, it is not necessary to move the polarity switching device 50 together with the belt 10.

Figure 7D:
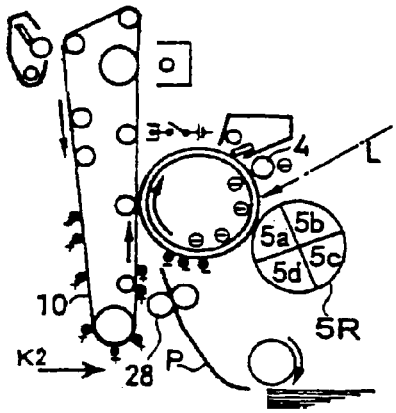

As shown in FIG. 7D, a toner image or second image of negative polarity is formed on the drum 1 while the belt 10 is again moved into contact with the drum 1 and then turned in the forward direction or counterclockwise. The sheet P is driven by the registration roller pair 28 at such a timing that the first and second images are accurately positioned on the sheet P.

Figure 7E:
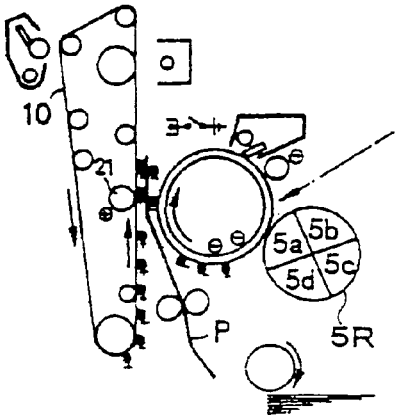

As shown in FIG. 7E, the image transferring means 21, which is applied with a positive voltage, transfers the toner image of positive polarity carried on the belt 1 and the second toner image of negative polarity formed on the drum 1 to the sheet P at the same time.

Figure 7F:
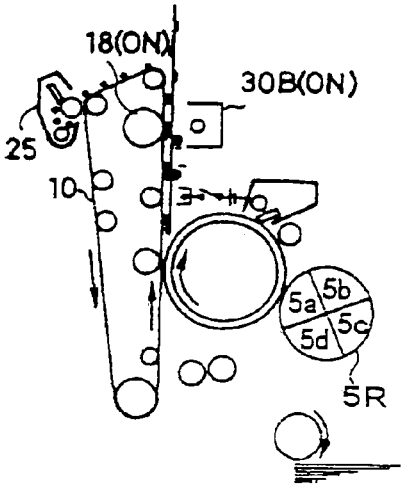

Finally, as shown in FIG. 7F, the belt 10 in movement conveys the sheet P carrying the first and second images thereon to the fixing position. The fixing means 18 and 30B are heated, or turned on, to fix the first and second images on the sheet P. At this instant, the belt cleaner 25 is pressed against the belt 10 for removing toner left on the belt 10. In the specific configuration shown in FIG. 3, the sheet P separated from the belt 10 is conveyed to the fixing position.

In the procedure shown in FIGS. 6A through 6F or 7A through 7F, in the simplex print mode, a toner image is directly transferred from the drum 11 to the sheet P without the polarity switching device 50 being operated, i.e., in exactly the same manner as when two image transferring means are used.

In the procedure of FIGS. 6A through 6F or 7A through 7F, when a toner image is transferred from the drum 1 to the sheet P by way of the belt 10 in the simplex print mode, the polarity switching device 50 is operated to invert the polarity of the toner image. Such image transfer is executed in the same manner as in the duplex print mode except that the transfer of a second image to the drum 1 is not effected.

As stated above, even in the procedure in which a single image transferring means transfers a toner image carried on the second image carrier and a toner image formed on a first image carrier to both sides of a sheet at the same time, the belt 10 is moved in the reverse direction to the reference position after the transfer of the toner image to the second image carrier. It is therefore not necessary to wait until the belt 10 completes one full turn, thereby saving time. The reverse movement of the belt 10 is effective not only in the duplex print mode but also in the simplex print mode. Particularly, productivity is noticeably enhanced because the reverse movement of the belt 10 occurs at a speed two times as high as the speed of the forward movement.

In any one of the specific configurations described above, when a toner image to be transferred to the belt or second image carrier 10 has a large size in the direction of movement of the belt, the reverse movement of the belt 10 sometimes lowers productivity. For example, when the image size in the above direction is close to the circumferential length of the belt 10, it is rather desirable to cause the belt 10 to simply complete one turn than to reverse it. In this respect, the belt 10 should preferably be selectively reversed or continuously moved forward by one turn in accordance with the image size in the direction of movement of the belt 10. More specifically, the belt 10 should preferably be continuously moved by one turn when the image size is larger than a preselected size.

For example, assume that the maximum image size that can be transferred to the belt 10 is size A3 in a profile position, i.e., 420 mm in the direction of movement of the belt 10. Then, the belt 10 is reversed for image sizes smaller than A4 in a landscape position, i.e., 210 mm in the above direction or continuously moved forward by one turn for the image size of A4 in a landscape position or above. While the configurations using two image transferring means satisfactorily work without regard to such selective movement of the belt 10, even the condition with a single image transferring means can cope with the selective movement by inverting the polarity of a toner image while moving the belt 10 forward. In any case, the control over the belt 10 stated above prevents productivity from being lowered when image size is large or improves productivity when image size is small.

Figure 8A:
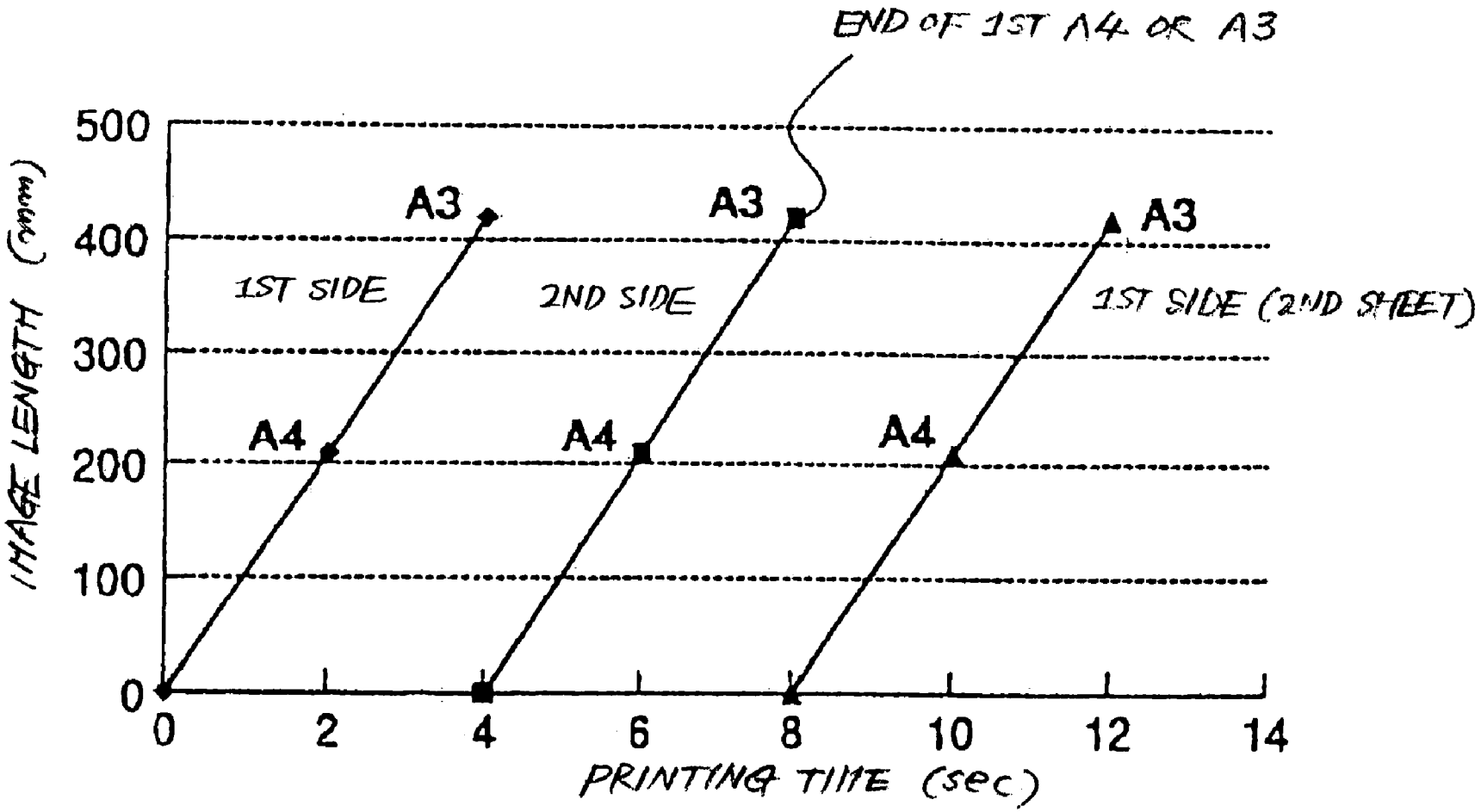
FIG. 8A PRIOR ART
FIGS. 8A and 8B are graphs comparing the illustrative embodiment and a conventional image forming apparatus as to printing time.
Figure 8B:
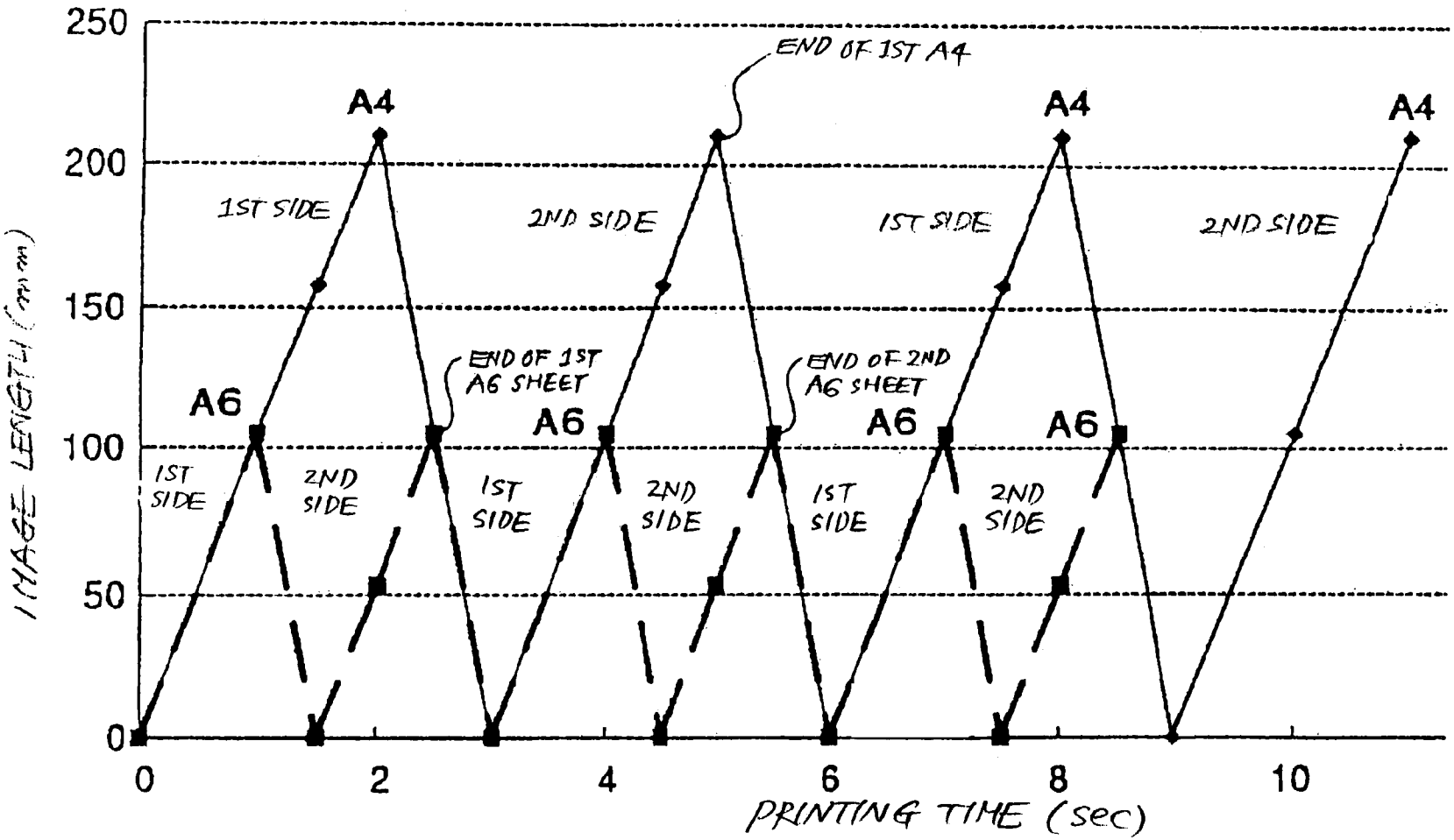

FIGS. 8A and 8B are graphs comparing a printing time achievable with the illustrative embodiment that varies the running condition of the belt or second image carrier 10 (reverse movement and acceleration) and a printing time particular to a conventional printer. In FIGS. 8A and 8B, the maximum size that can be transferred to the belt 10 is assumed to be the A3 profile size while the belt 10 is assumed to move at a speed of 100 mm/sec.

As shown in FIG. 8A, in the conventional printer, the printing time is fixed because a single print is produced by one full turn of a belt. Therefore, 8 seconds are necessary for images for size A4 to be formed on both sides of a sheet. More specifically, 6 seconds are necessary even up to the end of transfer of the second image, i.e., 4 seconds for the belt to make one turn and 2 seconds for the formation of the second side.

By contrast, as shown in FIG. 8B, the illustrative embodiment needs only about 5 seconds for forming toner images of size A4 on both sides of a sheet. More specifically, it takes 2 seconds for the first side to be formed, 1 second for the belt 10 to be moved in the reverse direction, and 2 seconds for the second side to be formed. Further, when toner images of size A6 are to be formed on both sides of a sheet with the belt 10 being moved in the reverse direction, it takes 1 second for the first side to be formed, 0.5 second for the belt 10 to be reversed, and 1 second for the second side to be formed, i.e., about 2.5 seconds in total. In this respect, in the conventional system, 5 seconds are necessary up to the end of image transfer, i.e., 4 seconds for one turn of the belt and 1 second for the formation of the second side.

As stated above, assuming that the maximum size that can be transferred to the belt 10 is the A3 profile size, then the illustrative embodiment reduces the printing time when the image size is smaller than the A4 landscape size. When the image size is the A4 profile size or above, the above-described control that does not reverse the belt 10 should only be executed in accordance with the image size.

Figure 9A:
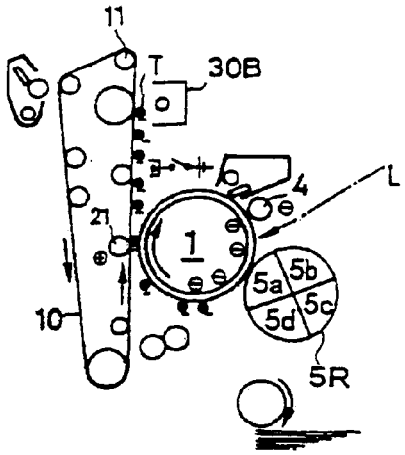
FIGS. 9A through 9F demonstrate a specific operation representative of an alternative embodiment of the present invention.

An alternative embodiment of the present invention will be described hereinafter. The alternative embodiment accelerates, after the transfer of a toner image from the first image carrier to the second image carrier, the second image carrier while moving it forward. This acceleration corresponds to varying of the running condition of the second image carrier. The illustrative embodiment is also practicable with any one of the configurations described with reference to FIGS. 1 through 4. Control particular to the illustrative embodiment will be described with reference to FIGS. 9A through 9F, which correspond to FIGS. 5A through 5F, respectively. In FIGS. 9A and 9E, while the drum 1 and belt 10 are shown as being spaced from each other, they are, in practice, held in contact with each other.

First, as shown in FIG. 9A, the charger 4 uniformly charges the surface of the drum 1 to negative polarity. The writing unit scans the charged surface of the drum 1 with the laser beam L to thereby form a latent image. The developing device 5 develops the latent image with negatively charged toner, which is represented by black dots in FIG. 9A, thereby producing a corresponding toner image. Subsequently, the first image transferring means 21, which is applied with a positive voltage, transfers the toner image from the drum 1 to the belt 10 (primary image transfer).

Figure 9B:
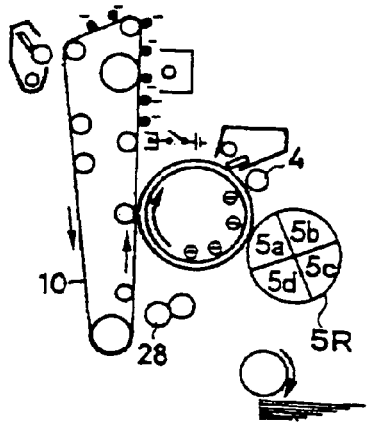
Figure 9C:
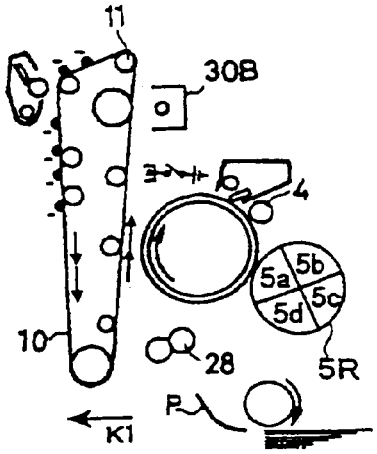

As shown in FIG. 9B, the primary image transfer of the first toner image ends. Subsequently, as shown in FIG. 9C, the belt 10 is released from the drum 1 in the direction K1 and then moved at a speed two times as high as the previous or usual speed.

Figure 9D:
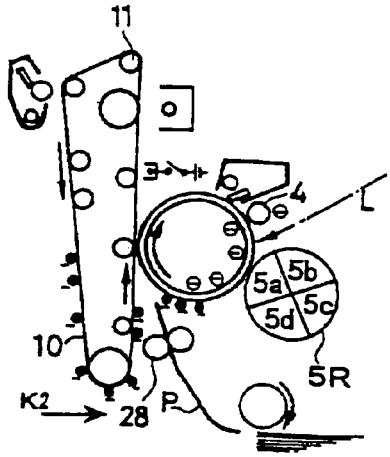
Figure 9E:
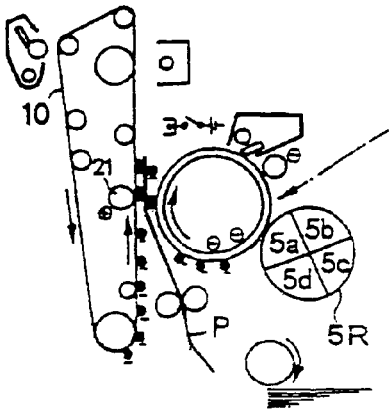

As shown in FIG. 9D, as soon as the belt 10 reaches the reference position, it is again moved at the usual speed and brought into contact with the drum 1 in the direction K2. On the other hand, a second toner image of negative polarity starts being formed on the drum 1. The sheet P is driven by the registration roller pair 28 at such a timing that the first and second images are accurately positioned on the sheet P.

The movement of the belt 10 to the reference position can be sensed on the basis of a period of time to elapse since the exposure for the first toner image or the previously mentioned timing mark provided on the belt 10. With this kind of scheme, it is possible to vary the belt speed and control belt movement. This can be done in terms of the number of steps in the case of a stepping motor.

As shown in FIG. 9E, the first image transferring means 21, which is applied with a positive voltage, transfers the second toner image of negative polarity from the drum 1 to the sheet P (secondary image transfer. At this instant, the first side of the sheet P is overlaid on the first image carried on the belt 10.

Figure 9F:
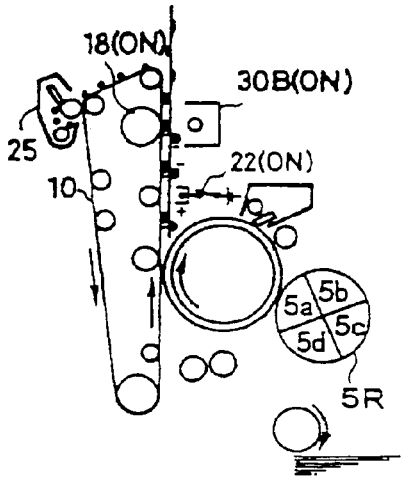

Finally, as shown in FIG. 9F, the second image transferring means 22, which is also applied with a positive voltage, transfers the first image of negative polarity from the belt 10 to the sheet P (tertiary image transfer). The belt 10 in movement conveys the sheet P carrying the first and second images thereon to the fixing position. The fixing means 18 and 30B are heated, or turned on, to fix the first and second images on the sheet P. At this instant, the belt cleaner 25 is pressed against the belt 10 for removing toner left on the belt 10. In the specific configuration shown in FIG. 3, the sheet P separated from the belt 10 is conveyed to the fixing position.

FIGS. 10A through 10F demonstrate another specific procedure available with the illustrative embodiment and uses the polarity switching device 50 like the procedure of FIGS. 7A through 7F. The polarity switching device 50 is fixed in place. Again, while the drum 1 and belt 10 are shown as being spaced from each other, they are, in practice, held in contact with each other.

Figure 10A:
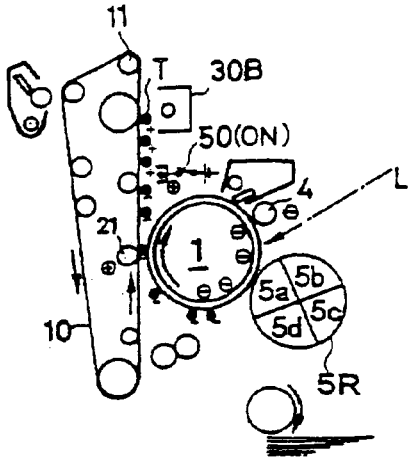
FIGS. 10A through 10F demonstrate another specific operation available with the alternative embodiment.

First, as shown in FIG. 10A, the charger 4 uniformly charges the surface of the drum 1 to negative polarity. The writing unit scans the charged surface of the drum 1 with the laser beam L to thereby form a latent image. The developing device 5 develops the latent image with negatively charged toner, which is represented by black dots in FIG. 10A, thereby producing a corresponding toner image. Subsequently, the image transferring means 21, which is applied with a positive voltage, transfers the toner image from the drum 1 to the belt 10 (primary image transfer). While the belt 10 conveys the toner image forward, the polarity switching means 50 is applied with a positive voltage, or turned on, to switch the polarity of the toner image from negative to positive.

Figure 10B:
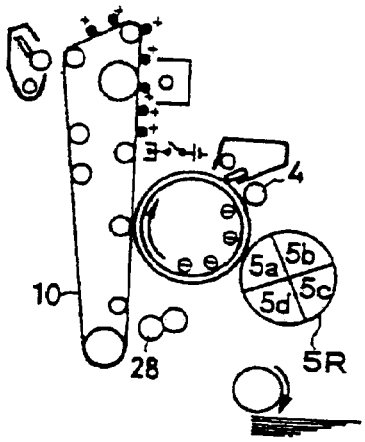
Figure 10C:
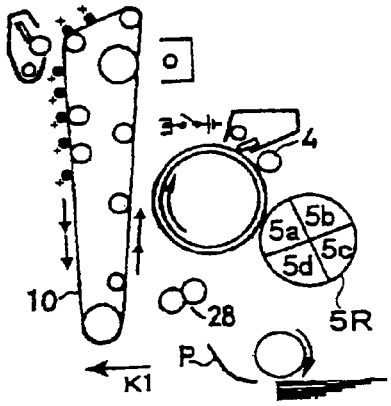

As shown in FIG. 10B, when the trailing edge of the toner image moves away from the polarity switching device 50, the entire toner image carried on the belt 10 has been inverted in polarity. Subsequently, as shown in FIG. 10C., the belt 10 is released from the belt 10 in the direction K1 and then moved at a speed two times as high as the previous or usual speed.

Figure 10D:
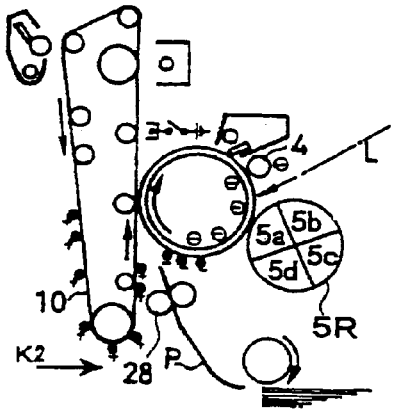

As shown in FIG. 10D, when the belt 10 reaches the reference position, it is again moved at the usual speed and brought into contact with the drum 1 in the direction K2. On the other hand, a second toner image of negative polarity starts being formed on the drum 1. The sheet P is driven by the registration roller pair 28 at such a timing that the first and second toner images are accurately positioned on the sheet P.

Figure 10E:
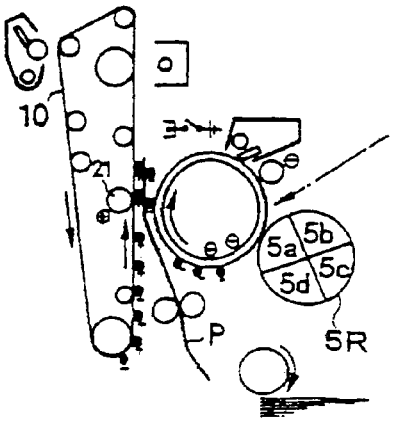

As shown in FIG. 10E, the image transferring means 21, which is applied with a positive voltage, transfers the toner image of positive polarity carried on the belt 1 and the second toner image of negative polarity formed on the drum 1 to the sheet P at the same time.

Figure 10F:
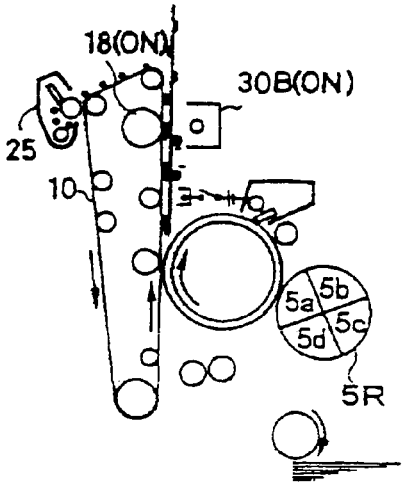

Finally, as shown in FIG. 10F, the belt 10 in movement conveys the sheet P carrying the first and second images thereon to the fixing position. The fixing means 18 and 30B are heated, or turned on, to fix the first and second images on the sheet P. At this instant, the belt cleaner 25 is pressed against the belt 10 for removing toner left on the belt 10. In the specific configuration shown in FIG. 3, the sheet P separated from the belt 10 is conveyed to the fixing position.

In the procedure shown in FIGS. 10A through 10F, in the simplex print mode, a toner image is directly transferred from the drum 1 to the sheet P without the polarity switching device 50 being operated, i.e., in exactly the same manner as when two image transferring means are used.

In the procedure of FIGS. 10A through 10F, when a toner image is transferred from the drum 1 to the sheet P by way of the belt 10 in the simplex print mode, the polarity switching device 50 is operated to invert the polarity of the toner image. Such image transfer is executed in the same manner as in the duplex print mode except that the second image is not formed on the drum 1.

As stated above, after the transfer of the toner image to the belt or second image carrier 10, the illustrative embodiment accelerates the movement of the belt 10 up to the reference position. This successfully reduces a period of time necessary for the belt 10 to complete one turn and therefore the image forming time. The acceleration of the belt 10 is effective not only in the duplex print mode but also in the simplex print mode. Stated another way, the illustrative embodiment improves productivity by varying the running condition of the belt 10.

When a toner image of maximum size is to be transferred to the belt 10, the illustrative embodiment does not accelerate the movement of the belt 10. This is because when such a toner image is transferred to the belt 10, the leading edge of the toner image reaches a position adjacent the secondary image transfer position when the trailing edge of the same is transferred from the drum 1 to the belt 10 or when it moves away from the polarity switching device 50.

So long as the image size to be transferred to the belt 10 is smaller than the maximum size, which is the A3 profile size or 420 mm in the direction of movement of the belt 10, the illustrative embodiment accelerates the movement of the belt 10 without exception to thereby enhance productivity. For example, the illustrative embodiment reduces the printing time to 85% with the A4 profile size, to 80% with the B5 profile size, to 75% with the A4 landscape size or to 65% with the A6 landscape size, compared to the conventional apparatus.

A specific configuration for moving the belt 10 included in any one of the illustrative embodiments into or out of contact with the drum 1 will be described hereinafter with reference to FIG. 11. As shown, the belt unit 20 includes a box-like frame 51 supporting the belt 10 thereinside. The rollers 11 through 13 are journalled to the frame 51 while the belt 10 is passed over the rollers 11 through 13. A tie bar or reinforcing member 51*b* connects the upper ends of opposite side walls of the frame 51. The fixing roller 18, image transfer roller 21 and so forth not relevant to the understanding of the specific configuration are not shown in FIG. 11.

A pulley 52 is mounted on one end of the roller 11 while a drive belt 54 is passed over the pulley 52 and a pulley mounted on the output shaft of a stepping motor 53. The stepping motor 53 is selectively driven in the forward or the reverse direction to thereby drive the belt 10 in the forward or the reverse direction. The stepping motor 53 is independent of a motor assigned to the drum or first image carrier 1.

The shaft of the roller 11 is journalled to the printer body or body frame, so that the belt unit 20 is angularly movable about the shaft of the roller 11. Springs 56 constantly bias the frame 51 upward toward the drum 1 at the bottom of the roller 13, thereby pressing the belt 10 against the drum 1 with preselected pressure. A member, not shown, included in the frame 51 abuts against a support member, which support the drum 1, for thereby accurately positioning the belt 10 and drum 1 relative to each other.

Bosses 55 protrude sideways from the end of the frame 51 adjacent to the roller 13 and are received in notches 58 formed in a generally U-shaped yoke 57. A shaft 59 extends throughout the intermediate portions of opposite side walls of the yoke 57 and is journalled to the body frame. A stub 60 protrudes from the end wall of the yoke 57. A solenoid 61 is mounted on the body frame above the stub 60 and includes a plunger 62. A spring 63 is anchored to the plunger 62 and stub 60 at opposite ends thereof.

Figure 11:
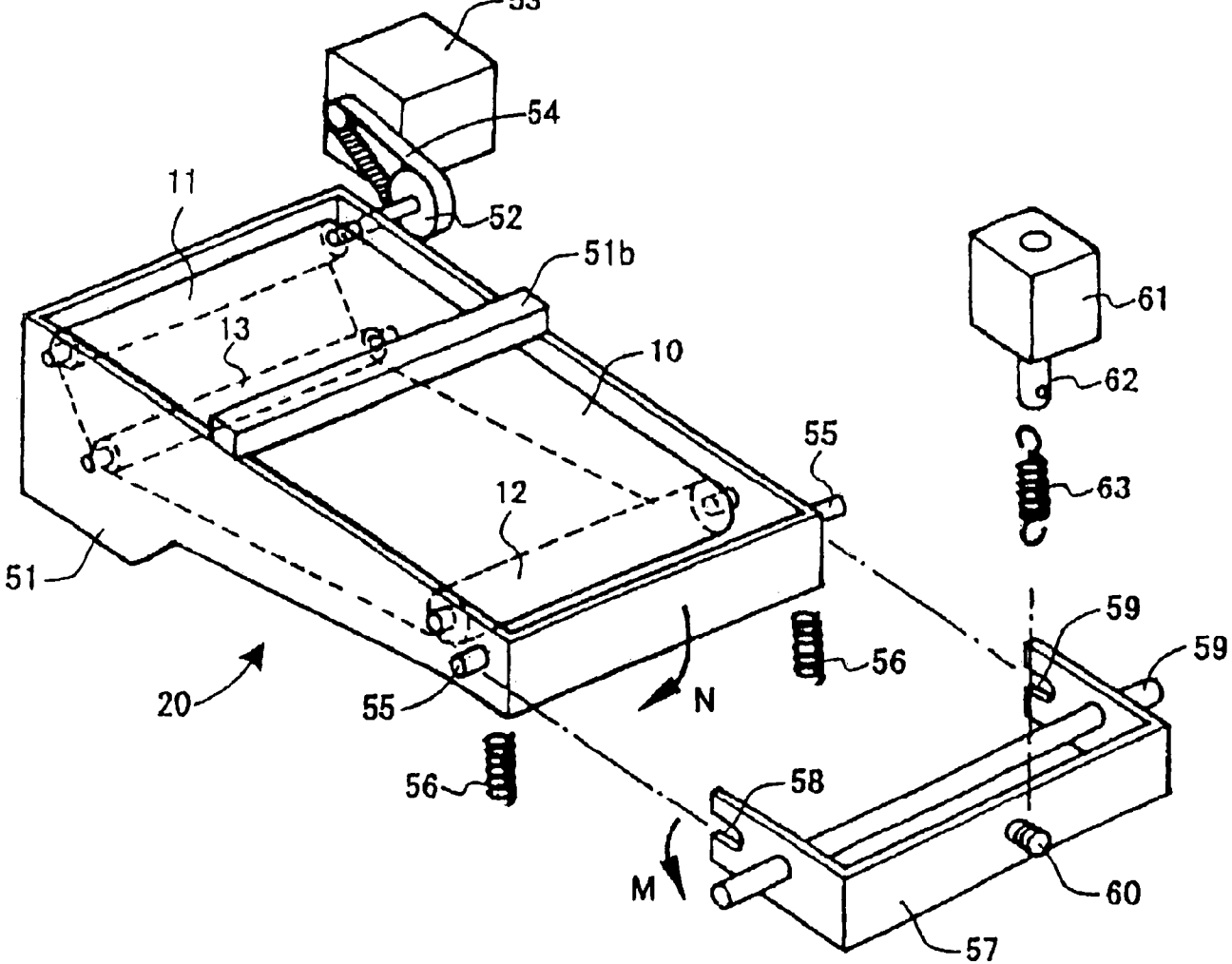
FIG. 11 is a perspective view showing a specific configuration of a mechanism for selectively moving an intermediate image transfer belt into or out of contact with a photoconductive drum.

In operation, when the solenoid 61 is energized, the plunger 62 thereof is retracted while causing the yoke 57 to angularly move counterclockwise about the shaft 59, as indicated by an arrow M in FIG. 11. Consequently, the bosses 55 of the frame 51 are forced downward against the action of the springs 56 and causes the belt unit 20 to bodily move about the shaft 11 clockwise, as indicated by an arrow N in FIG. 11, thereby releasing the belt 10 from the drum 1. When the solenoid 61 is deenergized, the plunger 62 is projected with the result that the belt unit 20 is moved in the direction opposite to the direction N by the springs 56, again bringing the belt 10 into contact with the drum 1. At this instant, the yoke 57 is, of course, moved in the direction opposite to the direction M.

Figure 12:
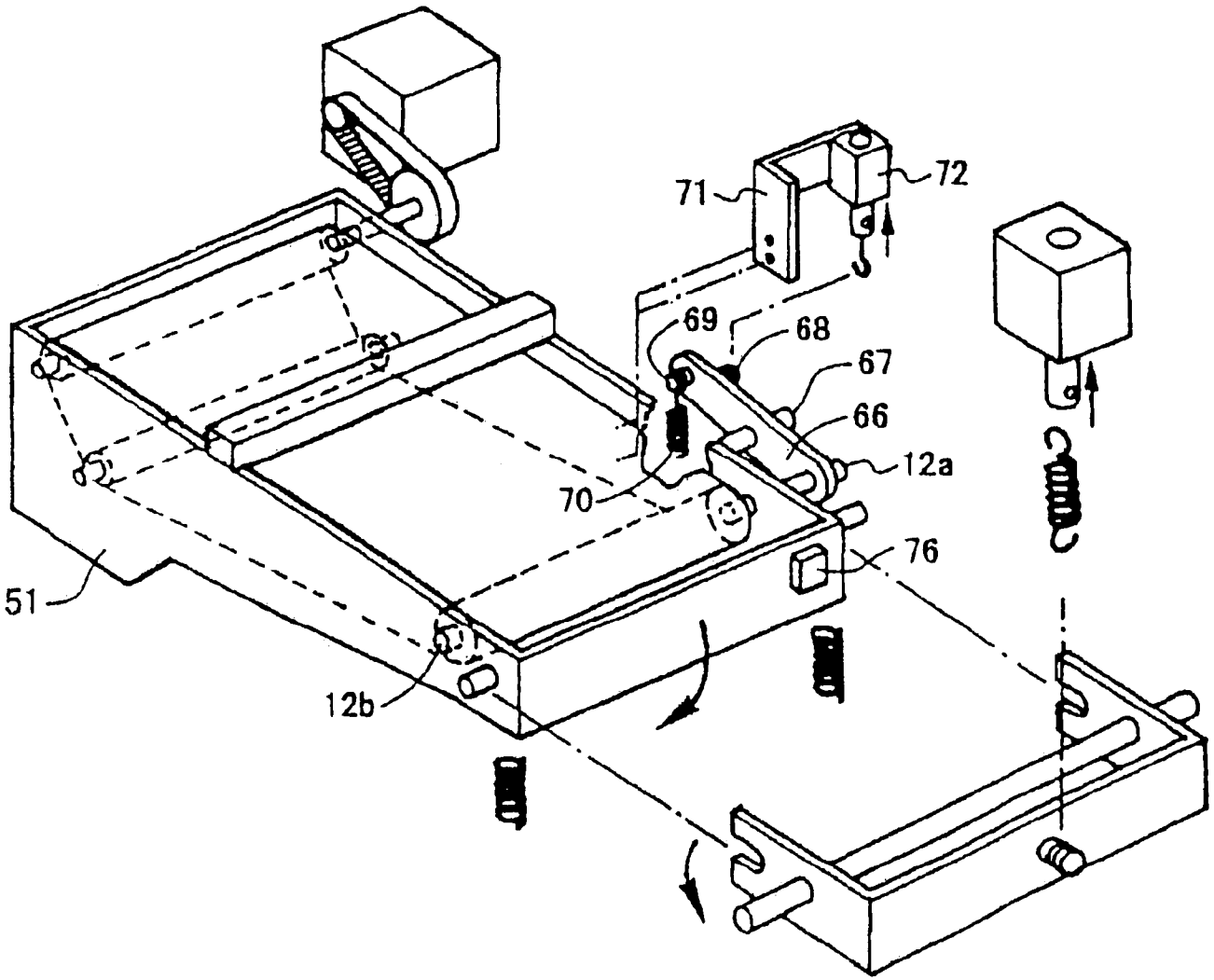
FIG. 12 is a perspective view showing a specific configuration of a mechanism for obviating the offset of the belt.

Reference will be made to FIGS. 12 and 13A through 13C for describing a specific mechanism for protecting the belt 10 from offset, i.e., preventing it from being dislocated sideways. In FIG. 12, structural elements identical with the structural elements of FIG. 11 are not labeled.

Figure 13A:
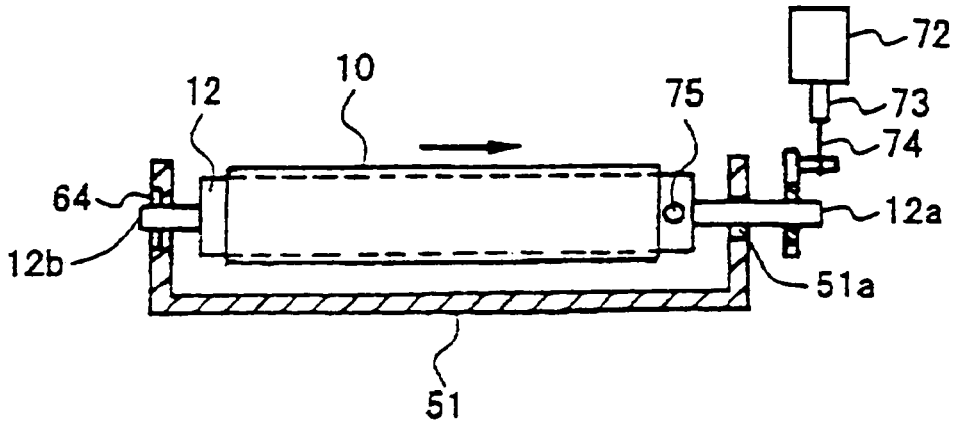
FIGS. 13A through 13C are side elevations showing the operation of the mechanism of FIG. 12.
Figure 13B:
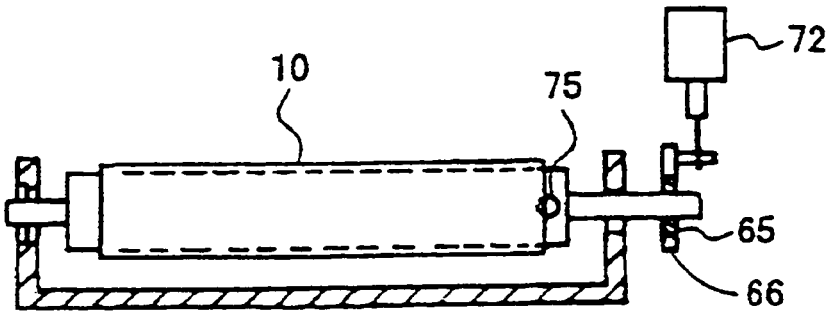
Figure 13C:
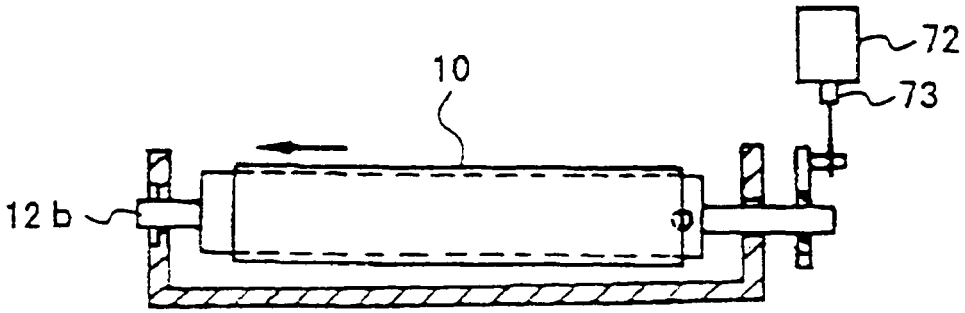

As shown in FIGS. 13A through 13C, the roller 12 over which the belt 10 is passed is slightly tiltable from the horizontal position. More specifically, a slot 51*a* is formed in the frame 51 through which one shaft 12*a* of the roller 12 extends, allowing the roller 12 to tilt. The other shaft 12*b* of the roller 12 is supported by the frame 51 via a bearing 64. A lever 66 is connected to the shaft 12*a* via a bearing 65. As shown in FIG. 12, the lever 66 is angularly movably supported by a shaft 67 protruding from the frame 51.

Pins 68 and 69 are studded on opposite surfaces of the lever 66 at the end of the lever 66 remove from the roller 12. A tension spring 70 is anchored to the pin 69 and frame 51 at its opposite ends, constantly biasing the pin 69 downward, i.e., biasing the lever 66 counterclockwise in FIG. 12. A solenoid 72 is mounted on the frame 51 via a bracket 71 and includes a plunger 73. A hook 74 is connected to the lower end of the plunger 73 and anchored to the pin 69.

When the solenoid 72 is deenergized, the pin 69 of the lever 66 is pulled downward by the tension spring 70 while pulling out the plunger 73. Consequently, the lever 66 is angularly moved clockwise in FIG. 12 to thereby lift the shaft 12*a*, as shown in FIG. 13A. In this condition, the roller 12 is slightly tilted from the horizontal position, i.e., raised at the shaft 12*a* side. Therefore, the belt 10 in turn tends to move toward the shaft 12*a* side of the roller 12, as indicated by an arrow in FIG. 13A. FIG. 13B shows the belt 10 shifted to the shaft 12*a* side.

As shown in FIG. 13C, when the solenoid 72 is energized, the plunger 73 is retracted while lifting the pin 68 against the action of the spring 70, so that the lever 66 angularly moves clockwise in FIG. 12. As a result, the roller 12 is slightly tilted from the horizontal position, i.e., lowered at the shaft 12*a* side. In this condition, the belt 10 in turn tends to move toward the shaft 12*b* side, as indicated by an arrow in FIG. 13C.

Further, a spot 75 is provided on one end portion of the roller 12 adjoining the shaft 12*a*. A sensor 76 is mounted on the inner surface of the frame 51 and emits a light beam toward the spot 75. When the belt 10 is shifted toward the shaft 12*a*, the belt 10 hides the spot 75. The resulting output of the sensor 76 indicates that the belt 10 has been shifted toward the shaft 12*a*. In this case, the solenoid 72 is energized to slightly lower the shaft 12*a* side of the roller 12 for thereby correcting the offset of the belt 10.

A spot and a sensor may also be located at the shaft 12*b* side of the roller 12, in which case, the solenoid 72 will be turned on or turned off in accordance with two sensor outputs.

The offset of the belt 10 can be corrected without resorting the mechanism of FIG. 12 if the belt 10 is moved in the reverse direction at a preselected timing over a preselected period of time. In any case, the offset of the belt 10 can be adequately controlled.

Some different configurations to which any one of the illustrative embodiments shown and described is applicable will be described hereinafter.

Figure 14:
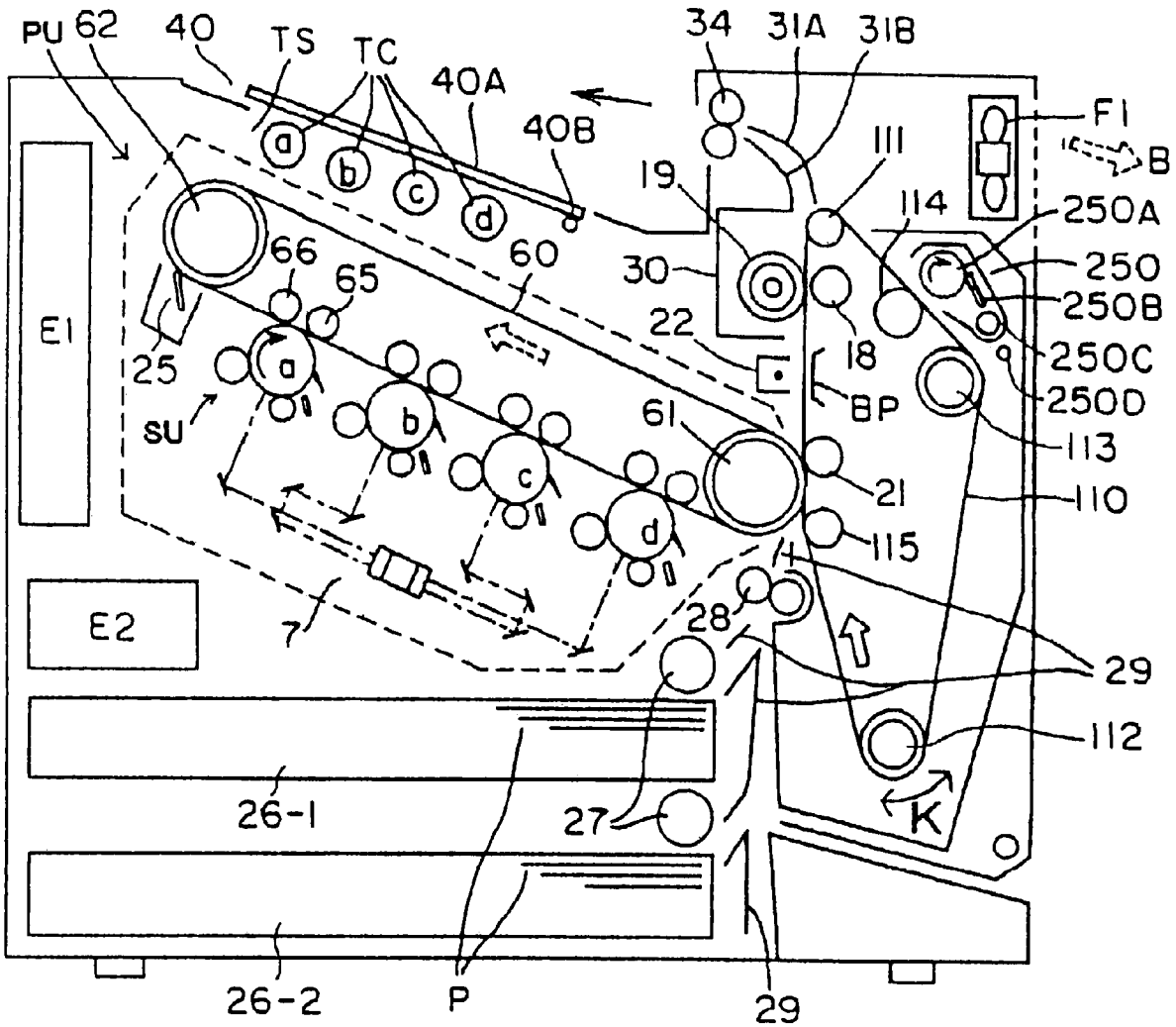
FIG. 14 is a view showing a specific configuration of an image forming apparatus including a first image carrier implemented as a belt.

FIG. 14 shows a full-color image forming apparatus including an image forming section PU arranged substantially at the center of the apparatus body. In the image forming section PU, four image forming units SU are arranged side by side along and in contact with the lower run of an inclined, intermediate image transfer belt 60. An optical writing unit 7 is positioned below the image forming sections SU. Because the image forming units SU are identical in configuration except for the color of toner, only one of them will be described with reference to FIG. 15.

Figure 15:
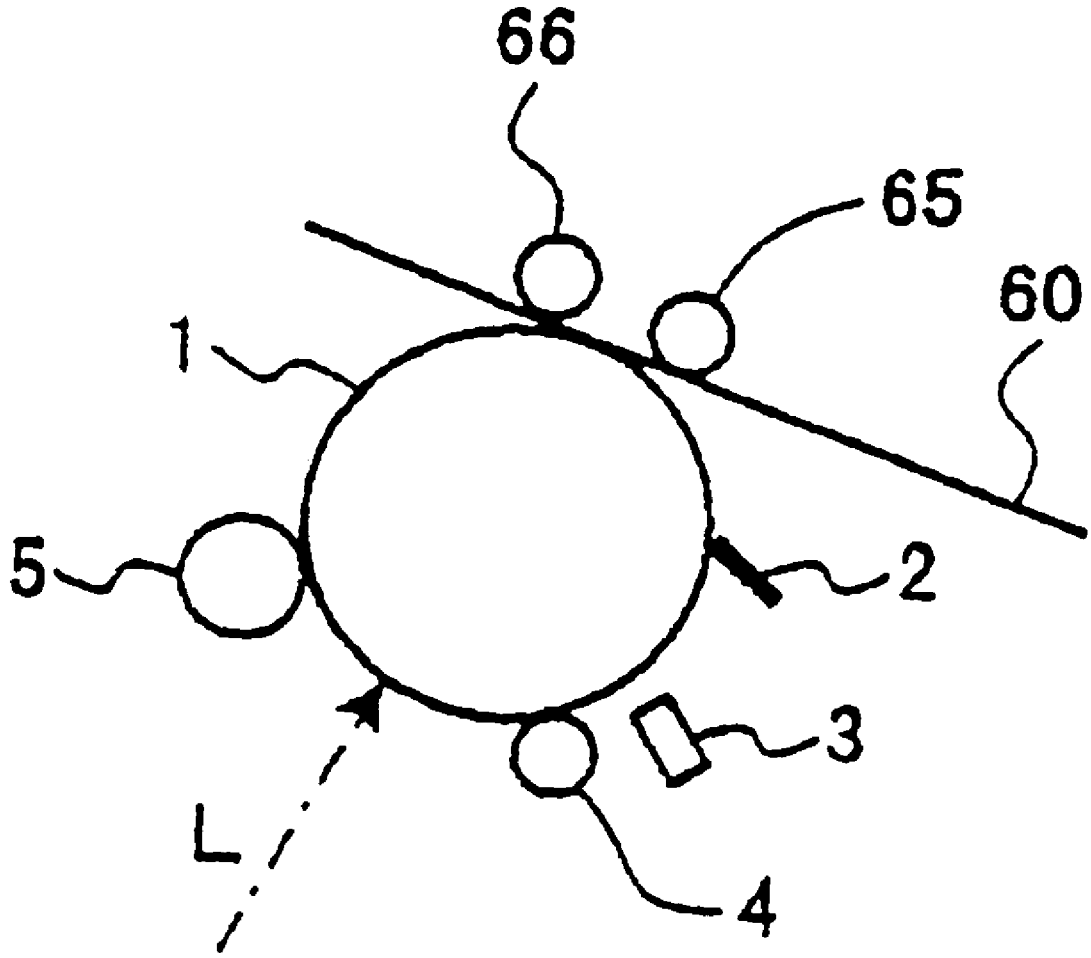
FIG. 15 is a section showing one of image forming units included in the apparatus of FIG. 14.

As shown in FIG. 15, each image forming unit SU includes the drum 1 around which the drum cleaner 2, discharger 3, charger 4 and developing device 5 are arranged. The developing device 5 stores any one of cyan toner, magenta toner, yellow toner and black toner and develops a latent image formed on the drum 1. The writing unit 7 scans the charged surface of the drum 1 with the laser beam L at the position between the charger 4 and the developing device 5. More specifically, using conventional laser optics, the writing unit 7 forms the latent image on the drum 1 in accordance with image data corresponding in color to the toner stored in the developing device 5. The laser optics may be replaced with an LED (Light Emitting Diode) array and focusing means, if desired. An image transfer roller 65 faces the drum 1 with the intermediary of the intermediate image transfer belt (simply belt hereinafter) 60. The reference numeral 66 designates a back roller. The image transfer roller 65 transfers the toner image formed on the drum 1 to the belt 60.

Referring again to FIG. 14, the belt 60 is passed over a drive roller 61 and a driven roller 62 and caused to turn counterclockwise by the drive roller 61. Members disposed in the loop of the belt 60 except for the image transferring means are suitably grounded via the apparatus body. The belt cleaner 25 faces the driven roller 62 via the belt 60. A toner replenishing section TS is positioned above the belt 60 and includes toner cartridges TC, i.e., a through d each storing toner of a particular color. Powder pumps, not shown, replenish the toner of different colors from the toner cartridges a through d to the developing devices.

In a full-color print mode, a cyan, a magenta, a yellow and a black toner image formed on the drums 1 by the four image forming units SU, respectively, are sequentially transferred to the belt 60 one above the other, forming a full-color image. In a monochromatic print mode, only the image forming apparatus SU storing the black toner forms a monochromatic toner image; the toner image is transferred to the belt 60. In the configuration shown in FIG. 14, among the four image forming units SU, the most downstream unit d stores the black toner in order to prevent productivity from being lowered in the monochromatic print mode.

Another intermediate image transfer belt or body 110 is positioned at the right-hand side of the image forming section PU. The intermediate image transfer belt (simply belt hereinafter) 110 is passed over rollers 111, 112, 113 and 115. The roller 111 is a drive roller driven by a stepping motor independent of the motor assigned to the drum 1 and belt 60, causing the belt 110 to turn. The belt 110 is angularly movable about the drive roller 111, as indicated by a double-headed arrow K. A moving mechanism, which will be described later, so moves the belt 110 into or out of contact with the belt 60.

The belt 10 is heat-resistant and provided with resistance that allows toner to be transferred to the belt 110. A mark, not shown, is provided on the belt 110 for controlling the system. In the event of power-up, the mark on the belt 10 is optically sensed to bring the belt 110 to a preselected reference or initial position.

The image transfer roller or first image transferring means 21 is positioned between the opposite runs of the belt 110 in the vicinity of the roller 61 supporting the belt 60. The heat roller 18, back rollers 114 and 115 and a back plate BP are also arranged inside of the loop of the belt 110. The roller 112 plays the role of cooling means at the same time. The members inside the loop of the belt 110 except for the image transferring means are suitably grounded via the apparatus body. A belt cleaner 250, the charger or second image transferring means 22 and so forth are arranged outside of the loop of the belt 110. The belt cleaner 250 assigned to the belt 110 includes a cleaning roller 250A, a blade 250B and toner conveying means 250C and wipes off toner left on the belt 110 after the transfer of a full-color image to a sheet. The belt cleaner 250 is angularly movable about a fulcrum 250D into or out of contact with the belt 110. In FIG. 14, the roller 250A is shown as being released from the belt 110. More specifically, the belt cleaner 250 is released from the belt 110 when a toner image to be transferred to a sheet is present on the belt 110, but brought into contact with the belt 110 when cleaning is required.

The image transfer roller 21, back roller 115 and roller 61 supporting the belt 60 cooperate to press the belts 60 and 110 against each other for thereby forming a preselected nip for image transfer. The charger 22 is positioned outside of the loop of the belt 110 and faces the back plate BP, which is positioned above the image transfer roller 21.

Two sheet cassettes 26-1 and 26-2 are positioned one above the other below the image forming section PU. The pickup roller 27 associated with designated one of the sheet cassettes 26-1 and 26-2 pays out the sheets P one by one toward the registration roller pair 28 via the guides 29.

The fixing device 30 faces the heat roller 18 with the intermediary of the belt 110. The fixing device 30 is angularly movable as in FIG. 1 such that the fixing roller 19 selectively moves into or out of contact with the belt 110. FIG. 14 shows the fixing roller 19 in a position where it contacts the belt 110.

The operation of the printer shown in FIG. 14 will be described hereinafter. On the power-up of the printer, the belt 110 is brought to its reference or initial position on the basis of the mark provided thereon.

In the duplex print mode, a first toner image to be transferred to the first side of a sheet P is formed by the image forming section PU and then transferred from the belt 60 to the belt 110, which is turning clockwise or forward. Subsequently, a second toner image is formed by the image forming section PU. At this instant, the second image transferring means 22, fixing device 30 and belt cleaner 250 are released from the belt 110 or otherwise held inoperative so as not to disturb the toner image.

After the entire first toner image has been transferred from the drum 60 to the belt 110, the belt 110 is reversed in the counterclockwise direction to the preselected position. The distance over which the belt 110 is reversed is controlled in terms of the number of steps of the stepping motor or drive means. In this specific configuration, the belt 110 is reversed at a speed two times as high as the speed of forward movement. The belt 110 is released from the belt 60 before the start of reverse movement. As soon as the belt 110 is returned to the preselected position, it is again brought into contact with the belt 60 and moved forward or clockwise.

On the other hand, a second toner image to be transferred to the second side of the same sheet P is formed by the image forming section PU. At the same time, the top sheet of designated one of the sheet cassettes 26-1 and 26-2 is paid out by the pickup roller 27 and conveyed toward the registration roller pair 28.

The second toner image is transferred from the belt 60 to the second side of the sheet P conveyed by the registration roller pair 28 at the preselected timing. This image transfer is effected by the image transfer roller or first image transferring means 21 positioned inside of the loop of the belt 110. At this time, the first image present on the belt 110 has been returned to the preselected position and is therefore overlaid on the first side of the sheet P. The sheet P carrying the second toner image on one side or second side and overlaid on the first image at the other side is conveyed by the belt 110 upward. The charger or second image forming means 22 transfers the first toner image from the belt 110 to the first side of the sheet P.

When the sheet P carrying the first and second toner images thereon reach the fixing device 30, the fixing roller 19 and heat roller 18 fix the toner images on the sheet P. For this purpose, the fixing roller 19 is brought into pressing contact with the heat roller 18 via the belt 110. Subsequently, the sheet P is separated from the belt 110 by curvature at the position where the roller 111 is located, and then driven out to the stack portion 40 by the roller pair 34. The belt 110 is continuously turned forward even after the separation of the sheet P, so that the belt cleaner 250 cleans the surface of the belt 110.

In the simplex print mode, a toner image formed by the image forming section PU is directly transferred from the belt 60 to a sheet P without the intermediary of the belt 110. In this case, the belt 110 should only be turned forward in synchronism with the belt 60 without any reverse movement.

As stated above, a toner image formed by the image forming section PU is transferred from the belt 60 to either one of the sheet P and belt 110. In this sense, the belts 60 and 110 play the role of the first and second image carriers, respectively.

Again, after the transfer of a toner image to the belt or second image carrier 110, the belt 110 is reversed to the preselected position. It is therefore not necessary to wait until the belt 110 complements one full turn, promoting rapid image formation. Particularly, productivity is enhanced because the belt 110 is moved at a higher speed during reverse movement than during forward movement.

Assume that the maximum image size that can be transferred to the belt 110 is the A3 profile size or 420 mm in the direction of rotation of the belt 110. Then, the belt 110 is reversed if the image size is smaller than the A4 landscape size or 210 mm, but is not done so if the image size is the A4 landscape size or above. This successfully preserves high productivity when the image size is large or improves productivity when the image size is small.

In the specific configuration shown in FIG. 14, the image transfer roller or first image transferring means 21 is disposed in the loop of the belt 110 and applied with a charge opposite in polarity to the toner so as to transfer the toner by attraction. Alternatively, the first image transferring means may be disposed in the loop of the belt 60, e.g., the roller 61 may be implemented as an image transfer roller and applied with a charge of the same polarity as the toner, in which case the toner will be transferred by repulsion. In this alternative arrangement, the roller 21 in the loop of the belt 110 may be implemented as a grounded back roller.

Figure 16B:
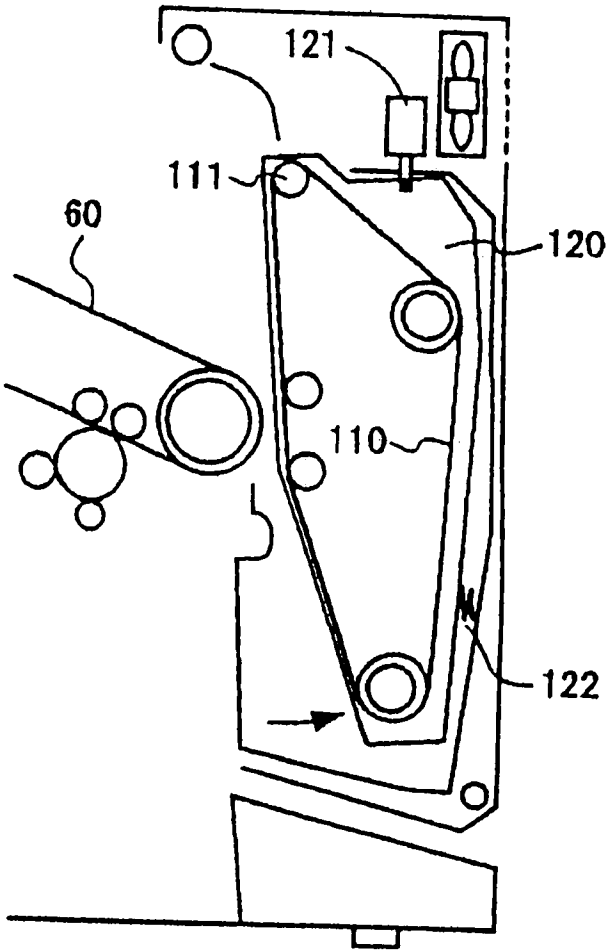
FIGS. 16A and 16B are sections showing a specific configuration for selectively moving a second image carrier included in the apparatus of FIG. 14 into or out of contact with the first image carrier.
Figure 16A:
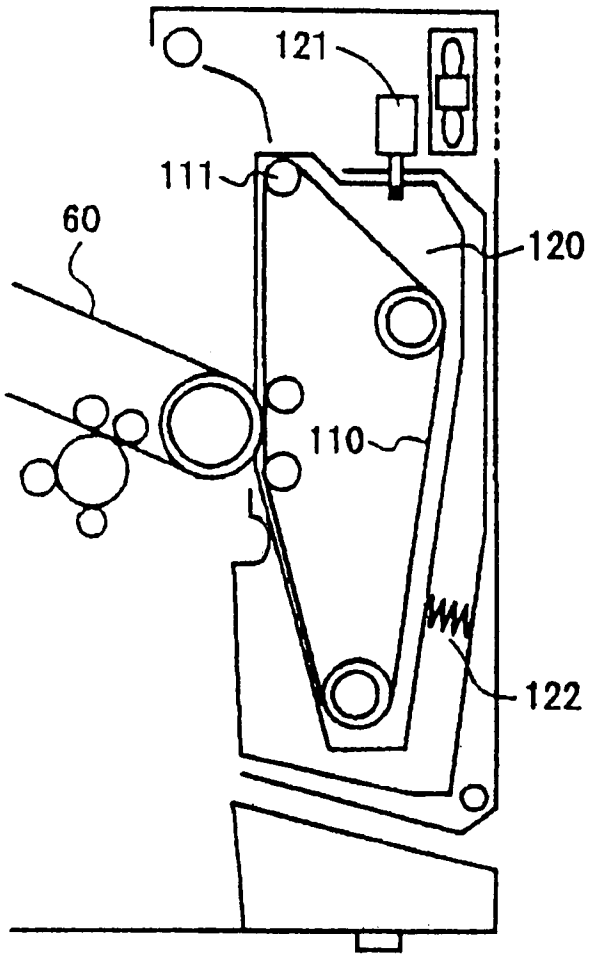

FIGS. 16A and 16B show a specific configuration of the mechanism for moving the belt or second image carrier 110 into or out of contact with the belt 60. As shown, the rollers over which the belt 110 is passed are journalled to a frame 120, which is angularly movable about the shaft of the roller 111. A spring 122 is loaded between the frame 120 and the printer body for constantly biasing the frame 120 clockwise, as viewed in FIGS. 16A and 16B. A solenoid 121 is mounted on the printer body above the frame 120 and has a plunger connected to the frame 120.

As shown in FIG. 16A, when the solenoid 121 is deenergized, the belt is pressed against the belt 60 under the action of the spring 122. As shown in FIG. 16B, when the solenoid 121 is energized, it causes the frame 120 to angularly move counterclockwise away from the belt 60 against the action of the spring 22. The belt 110 is held in the position of FIG. 16B when reversed at the higher speed.

Figure 17B:
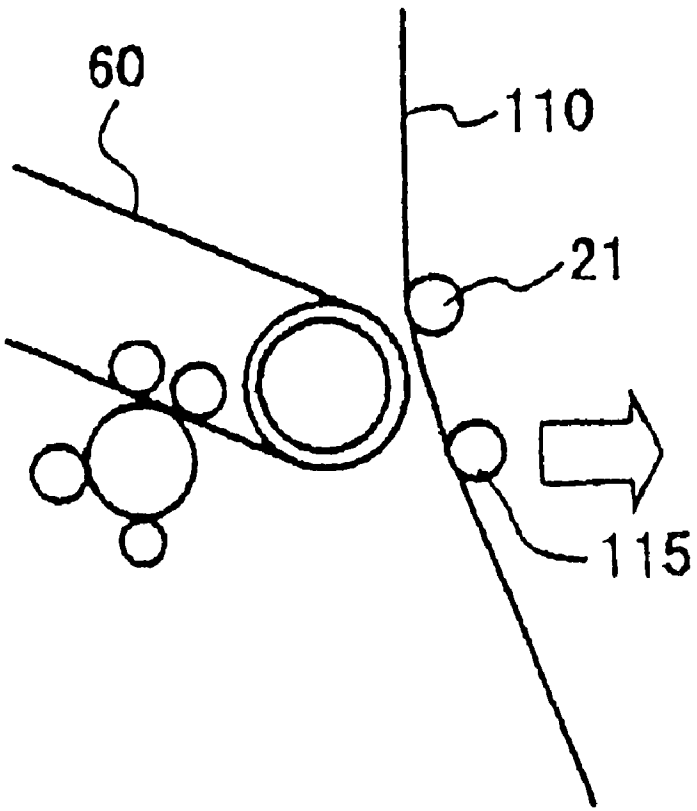
FIGS. 17A and 17B are fragmentary sections showing another specific configuration for moving the second image carrier.
Figure 17A:
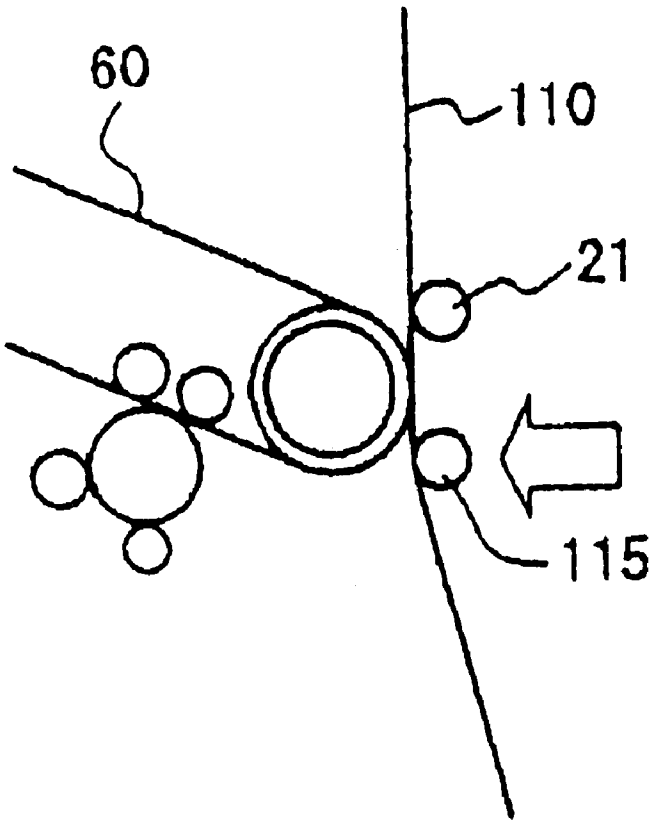

FIGS. 17A and 17B show another specific configuration of the moving mechanism. As shown, this moving mechanisms does not move the entire frame supporting the belt 110, but moves only a belt support roller 115 with, e.g., a solenoid for thereby moving the belt 110 into or out of contact with the belt 60. The image transfer roller 21 may be moved integrally with the belt support roller 115, if desired. It is preferable to provide an arrangement that maintains the belt 110 under tension when the belt 110 is spaced from the belt 60.

Figure 18A:
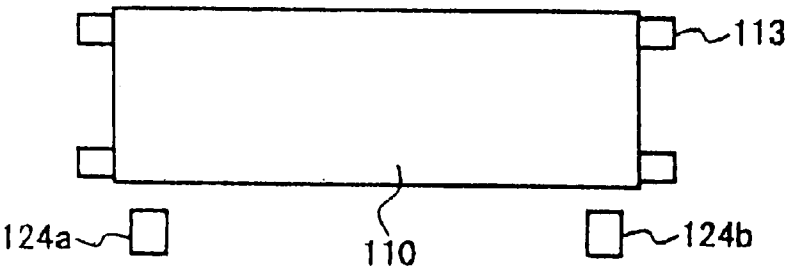
FIGS. 18A through 18C show specific timing marks formed on the second image carrier and means for sensing the timing marks.
Figure 18B:
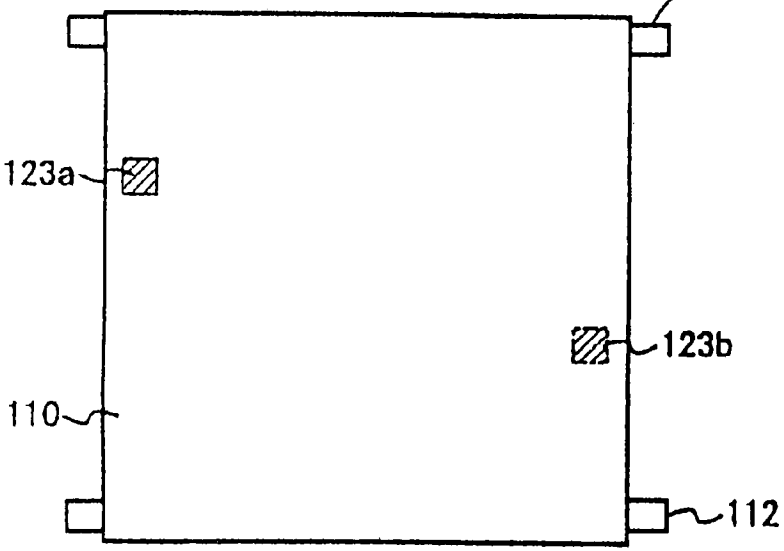
Figure 18C:
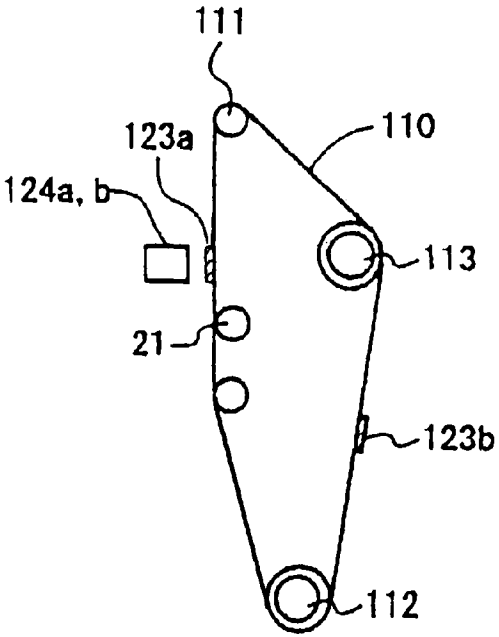

FIGS. 18A through 18C show a specific mechanism for sensing the position of the belt 110 in a top plan view, a side elevation and a front view, respectively. As shown, timing marks 123*a* and 123*b* are provided on the outer surface of the belt 110 adjacent opposite edges of the belt 110 in the widthwise direction. The distance between the timing marks 123*a* and 123*b* is selected to be one-half of the circumferential length of the belt 110. Sensors 124*a* and 124*b*, which respectively sense the timing marks 123*a* and 123*b*, adjoin the opposite edge portions of the belt 110 and face the portion of the belt 110 adjacent the image transfer roller 21, but slightly above the roller 21. The timing marks 123*a* and 123*b* are painted in a color different from the color of the surface of the belt 110. The sensors 124*a* and 124*b* may be implemented as a reflection type photosensor each.

Figure 19:
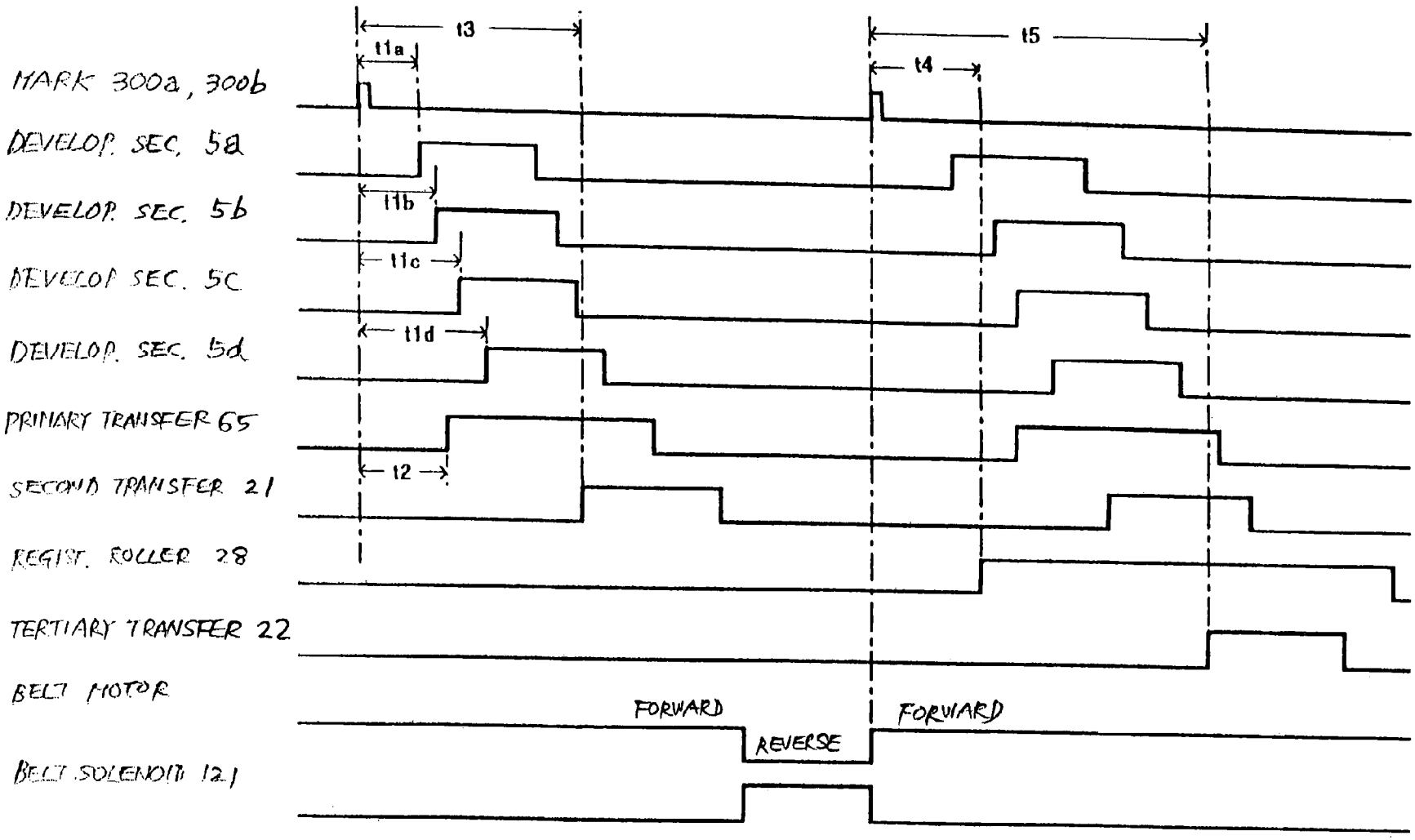
FIG. 19 is a timing chart representative of a specific operation of the apparatus shown in FIG. 14.

The timing marks 123*a* and 123*b* and sensors 124*a* and 124*b* are used to control the position of the belt 110, i.e., movement to the reference or initial position and variation of the running condition. While the position of the belt 110 can be controlled with a single timing sensor and a single sensor, two timing marks 123*a* and 123*b* and two sensors 124*a* and 124*b* are successful to extend the life of the belt 110. Particularly, in the configuration that reverses the belt 110 and when images of small sizes are frequently formed, the timing marks 123*a* and 123*b* spaced from each other by the previously stated distance prevent only the same portion of the belt 110 from being repeatedly used for thereby protecting the belt 110 from deterioration FIG. 19 is a timing chart demonstrating the operation of the printer to occur in the duplex print mode. As shown, on the elapse of periods of time T1*a*, t1*b*, t1*c* and t1*d* since the sensor 124*a* or 124*b* has sensed the timing mark 123*a* or 123*b*, the yellow, magenta, cyan and black developing sections 5*a* through 5*d* of the image forming unit SU, respectively, start development. On the elapse of a period of time t2 since the sensing of the timing mark, primary image transfer is effected from the drums 1 of the image forming unit SU to the belt or first image carrier 60 by the image transferring means 65. Further, on the elapse of a period of time t3 since the sensing of the timing mark, secondary image transfer is effected from the belt 60 to the belt or second image carrier 110 by the image transferring means 21.

After the secondary image transfer, the solenoid 121 of the moving mechanism is energized to release the belt 110 from the belt 60. At the same time, the motor assigned to the belt 110 is stopped and then reversed at the higher speed. When the belt 110 is returned to the preselected position, as determined by sensing the timing mark 123*a* or 123*b*, the above motor is stopped and then driven forward at the lower or usual speed. Such a procedure is repeated up to the last image. On the elapse of a period of time t4 since the end of return of the belt 110, the registration roller 28 is driven to convey a sheet. Subsequently, on the elapse of a period of time t5, tertiary image transfer is effected by the image transferring means 22.

Figure 20:
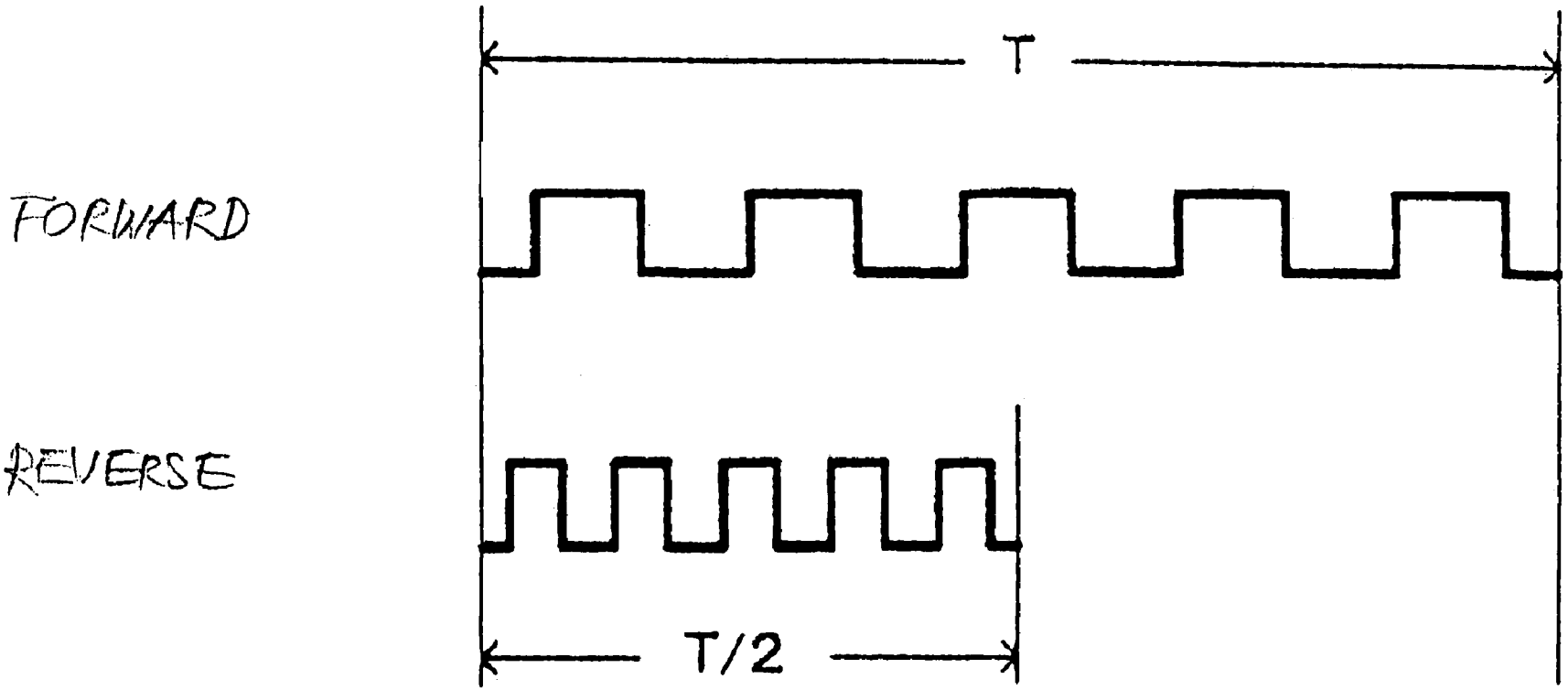
FIG. 20 demonstrates specific speed control over a stepping motor assigned to the second image carrier.

When the belt 110 is reversed, the same number of pulses as when it is moved forward are fed to the stepping motor, but within half a period of time, thereby doubling the belt speed. Such control over the stepping motor is demonstrated in FIG. 20.

While the configuration of FIG. 14 uses the first embodiment that reverses the belt 110, it may alternatively use the second embodiment that accelerates the belt 110 in the forward direction. In the first embodiment, a single image transferring means and a polarity switching device may be used to transfer images to both sides of a sheet at the same time, as described with reference to FIGS. 6A through 6F or 7A through 7F. This is also true with the second embodiment, as described with reference to FIGS. 10A through 10F. Further, the fixing device may have the configuration shown in FIG. 2 or 3.

Figure 21:
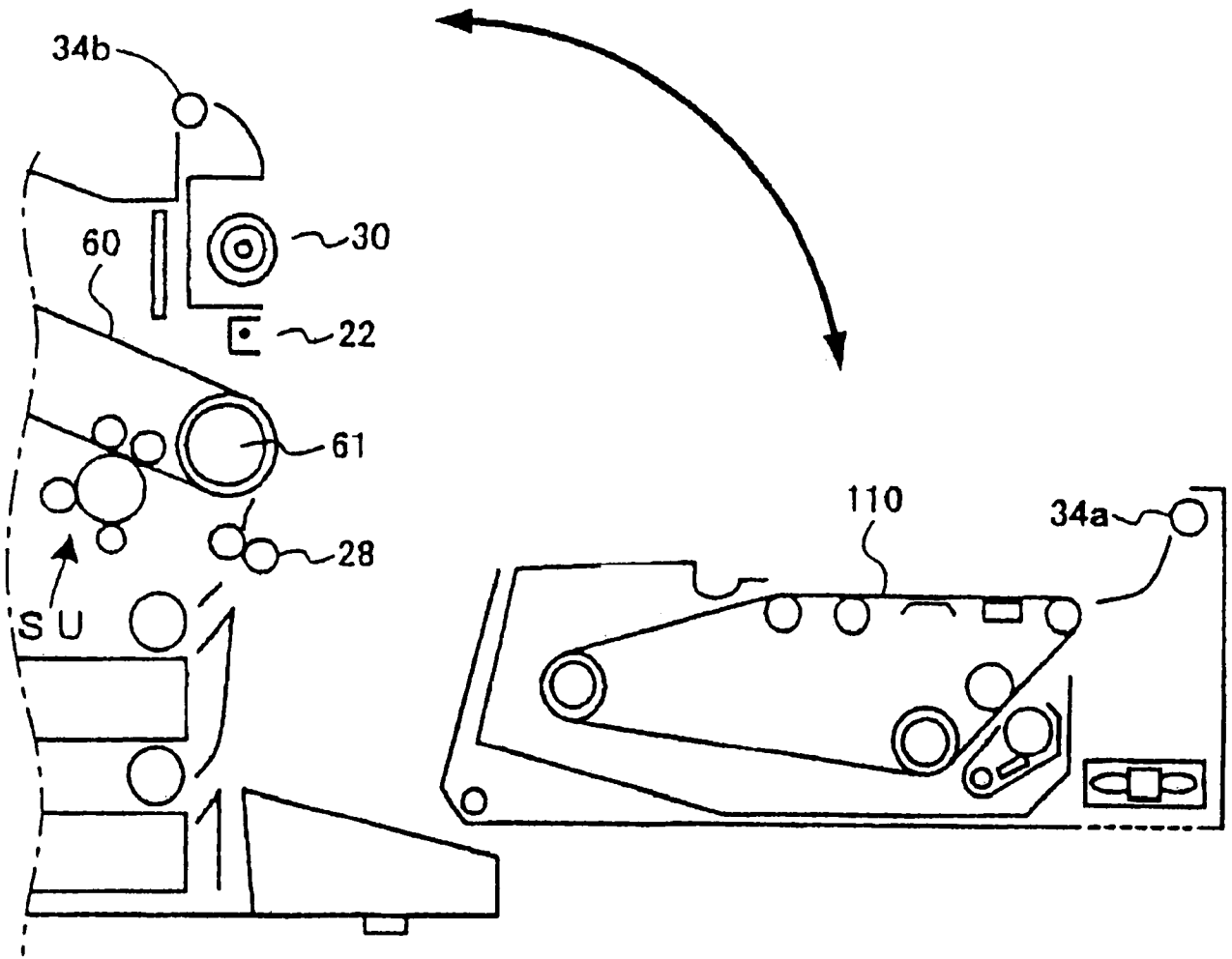
FIG. 21 is a section showing a unit, which includes the second image carrier of the apparatus shown in FIG. 14, in an open position.

As shown in FIG. 21, the unit including the belt or second image carrier 110 is configured to be openable away from the printer body. The openable unit additionally includes the members and devices arranged inside of the loop of the belt 110 as well as the belt cleaner 250. Upper one and lower one of the outlet rollers 34, respectively labeled 34*a* and 34*b*, are mounted on the openable unit and printer body, respectively. When the openable unit is opened away from the printer body, the sheet path extending from the sheet feed section to the outlet roller pair 34 is uncovered to facilitate access in the event of a jam.

Figure 22:
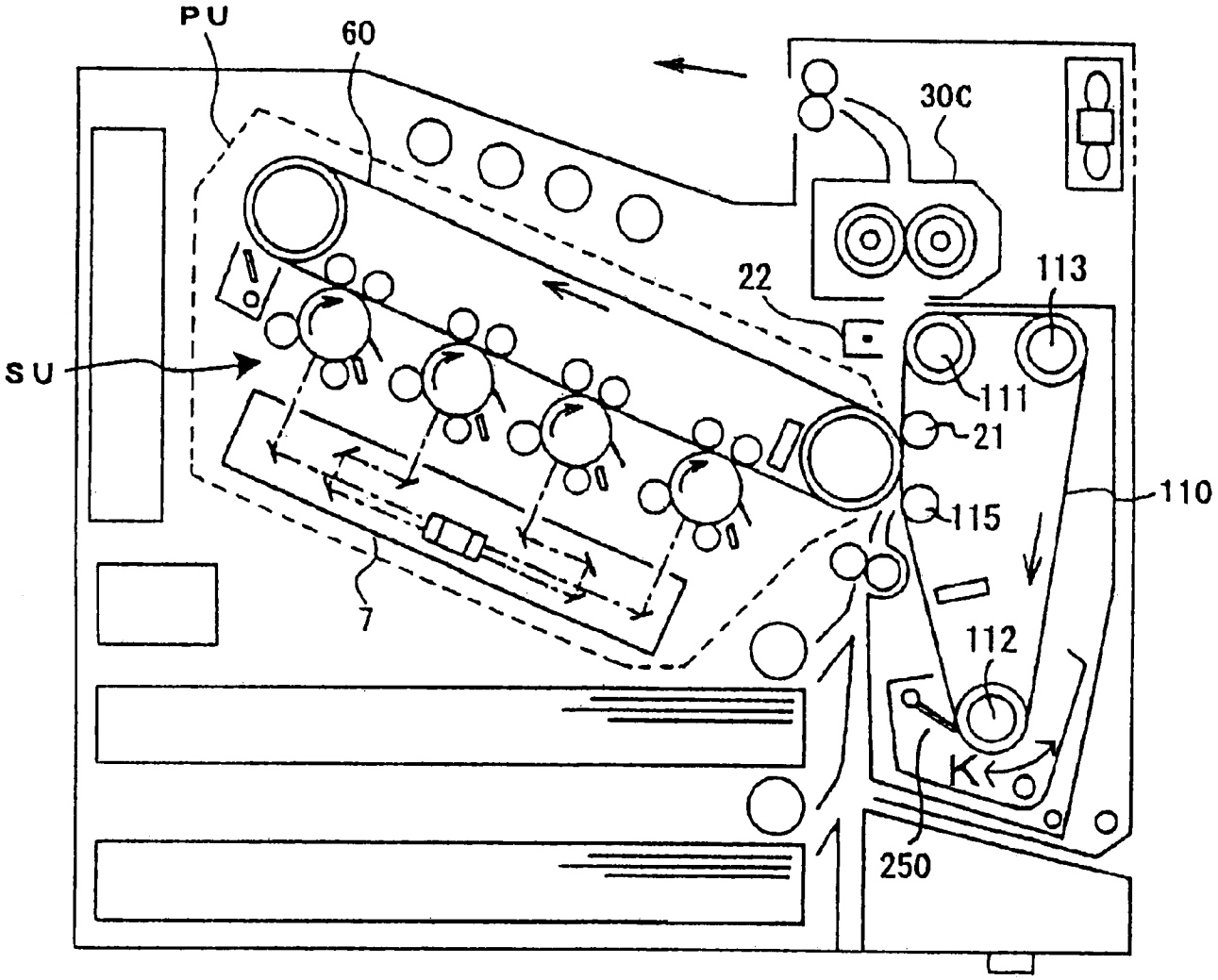
FIG. 22 is a section showing another specific configuration of the image forming apparatus including another specific configuration of a fixing device.
Figure 23:
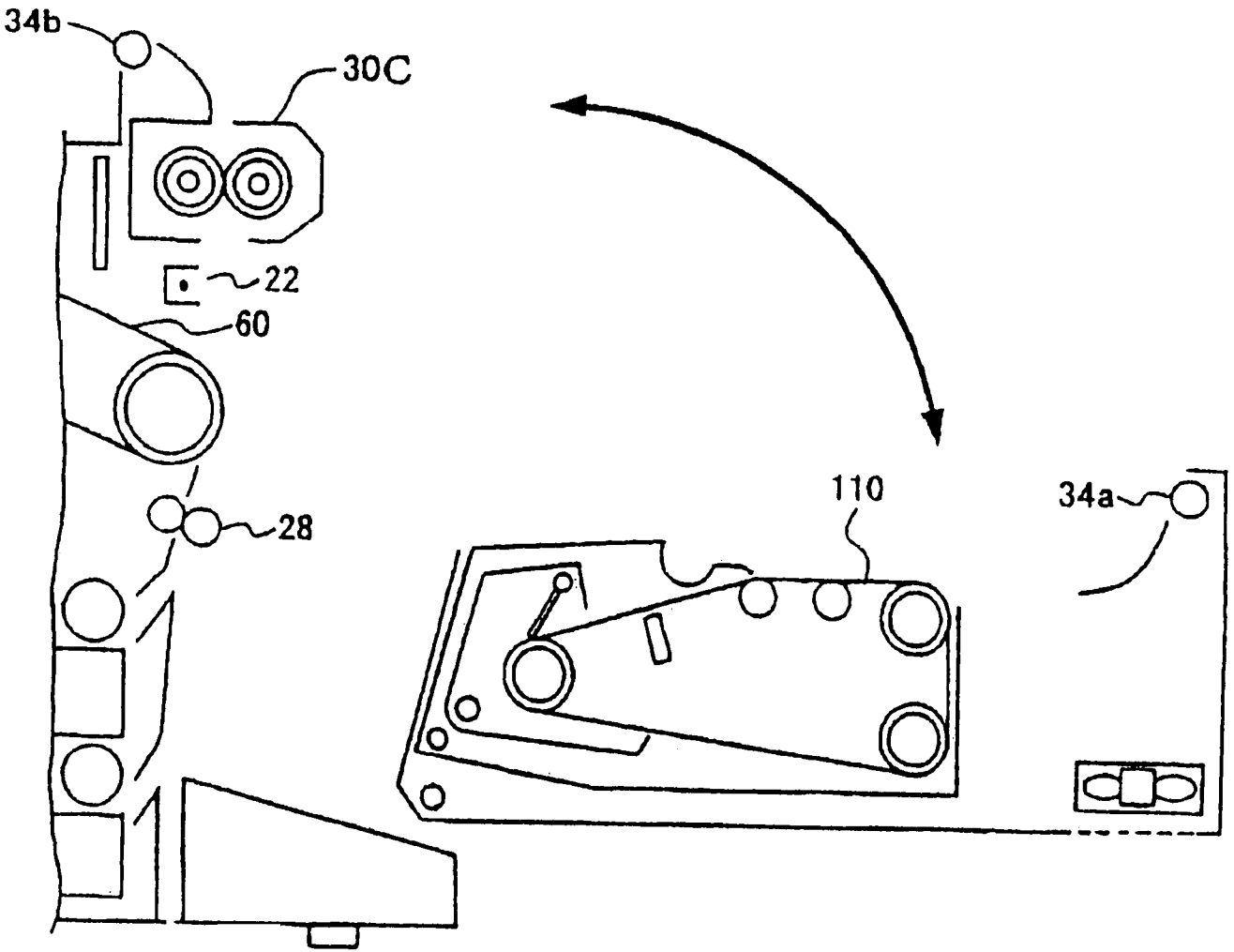
FIG. 23 is a fragmentary section showing a unit, which includes the second image carrier of the apparatus shown in FIG. 22, in an open position.

FIG. 22 shows a modification of the configuration described with reference to FIG. 14. As shown, a fixing device 30C is positioned outside of the loop of the belt 110. The belt cleaner 250 assigned to the belt 110 differs in configuration and position from the belt cleaner 250 of FIG. 14. As shown in FIG. 23, the unit including the belt 110 is also configured to be openable away from the printer body. In the modification, the fixing device 30C is mounted on the printer body and remains thereon when the openable unit is opened.

Figure 24:
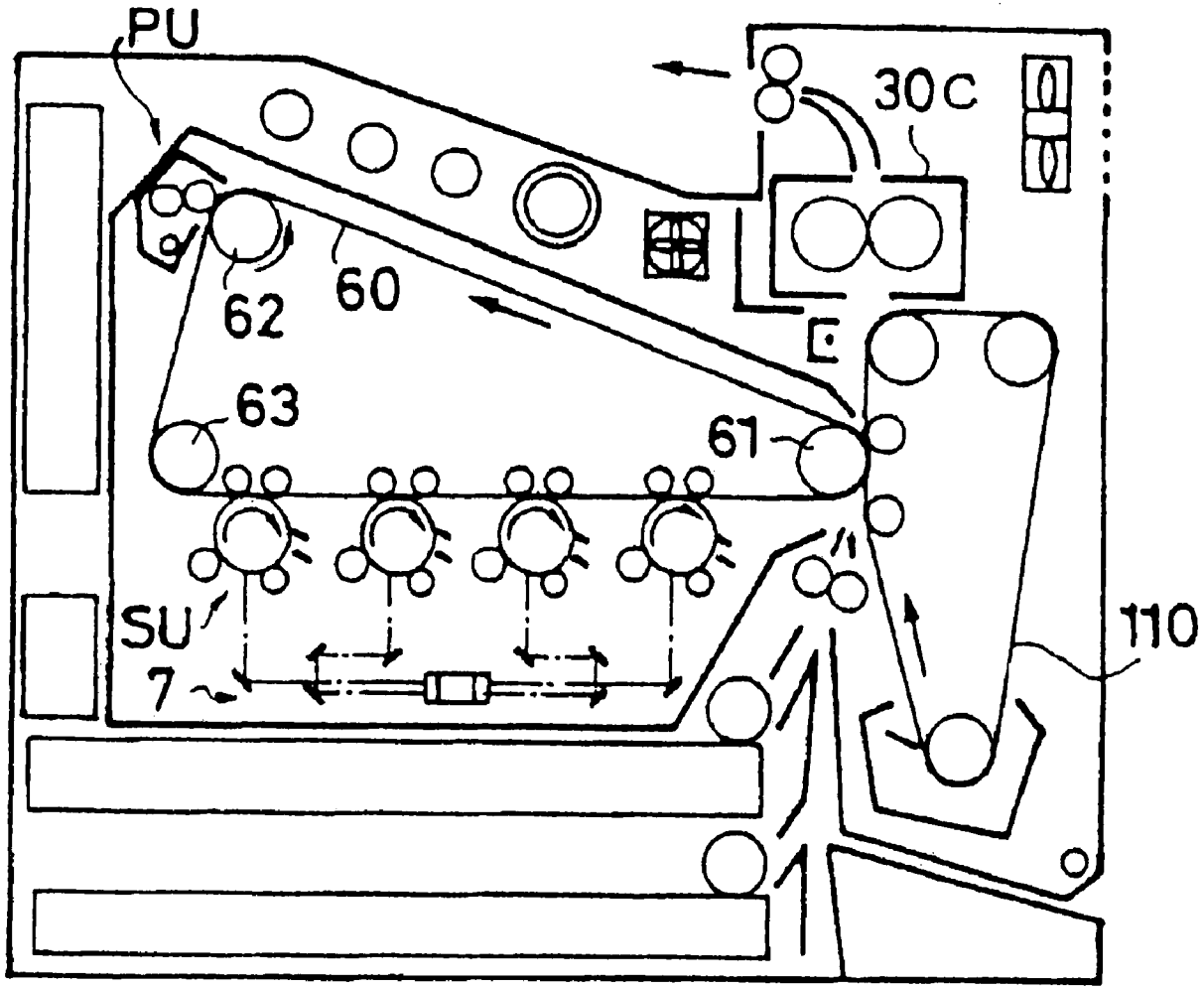
FIG. 24 is a section showing another specific configuration of the image forming apparatus.

FIG. 24 shows another specific construction identical with the construction of FIG. 14 or 22 except for the arrangement of the image forming section PU. As shown, the belt or first image carrier 60 is passed over three rollers 61, 62 and 63 in a triangular position. Four image forming units SU are arranged side by side along the lower run of the belt 60. The optical writing unit 7 is located below the image forming units SU in a horizontal position. As for the rest of the configuration, FIG. 24 is identical with FIG. 22. Again, the unit including the belt 110 is openable away from the printer body.

Figure 25:
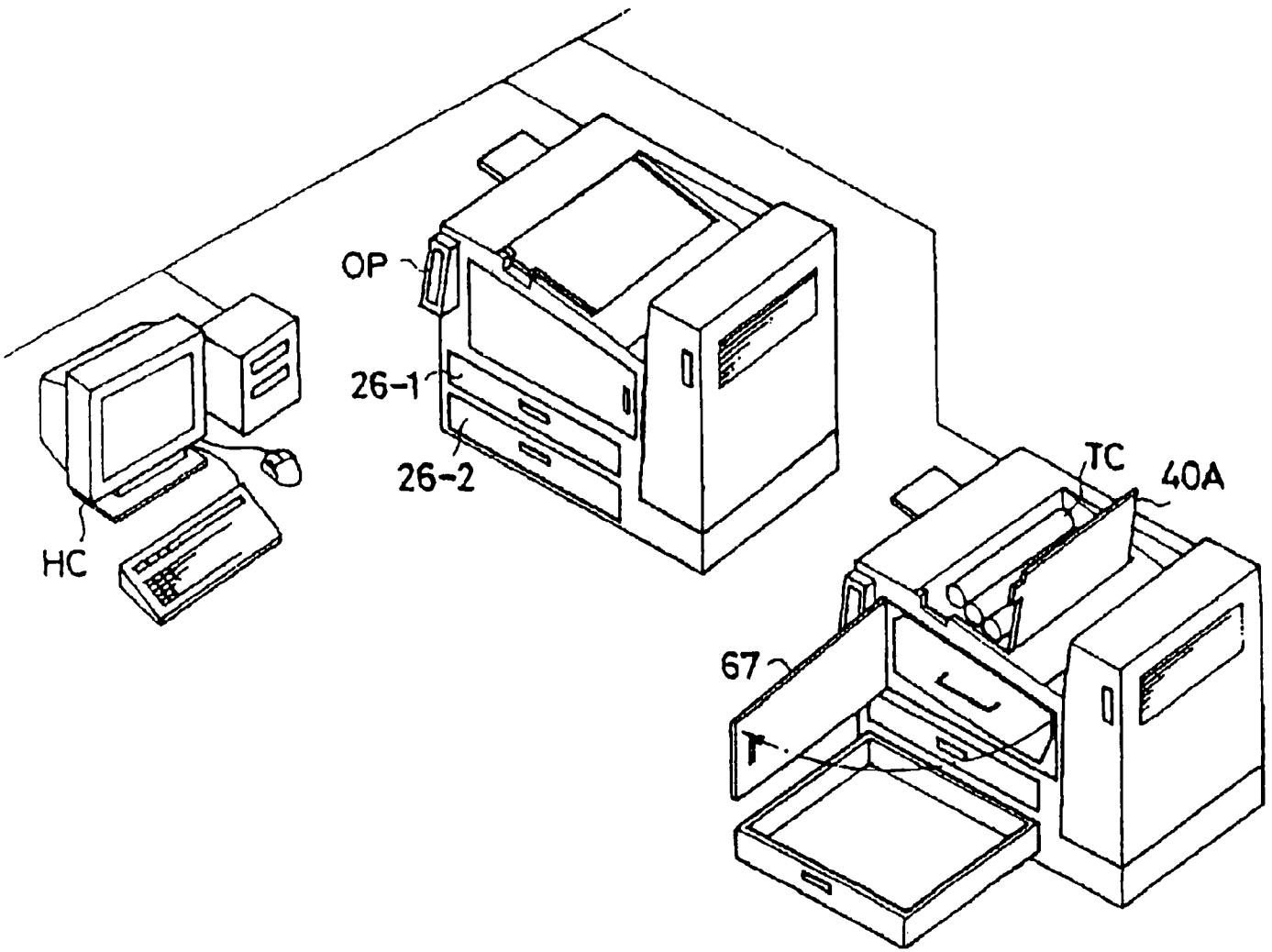
FIG. 25 is a perspective view showing a plurality of image forming apparatuses each having any one of the configurations of FIGS. 14, 22 and 24 and interconnected by a network.

Referring to FIG. 25, a specific system including two printers connected to a host computer HC by a network will be described. The two printers each may have any one of the specific configurations shown in FIGS. 14, 22 and 24. The network may be either wired or wireless. Labeled OP in FIG. 25 is an operation panel.

As best shown in FIG. 14, the printer of FIG. 14, 22 or 24 includes a cover 40A constituting the bottom of the stack portion 40 and openable about a shaft 40B. As shown in FIG. 25, when the cover 40A is opened, toner cartridges can be easily dealt with. Because the shaft 40B adjoins the outlet roller pair 34, prints stacked on the stack portion 40 are prevented from dropping even when the cover 40A is opened.

As shown in FIG. 25, a door 67 mounted on the front of each printer is openable about its left edge for uncovering the image forming section PU in the event of, e.g., maintenance. The belt 60, four image forming units SU and members arranged therearound constituting the image forming section PU can be pulled out of the printer body with the writing unit 7 being left on the printer body. Subsequently, the belt 60 and image forming units SU can be dismounted independently of each other. The image forming section PU is guided by guide rails, not shown, so that it can be easily, surely pulled out. The door 67 is hinged to the printer body in the vertical direction, making the members arranged in the lower portion to be easily seen in the event of maintenance. Moreover, sheets can be easily replenished to the sheet cassettes 26-1 and 26-2 even when the door 67 is open. A seal member, not shown, prevents the structural elements of the writing device 7 from being smeared by toner. A controller, not shown, allows the writing device 7 to selectively form a non-reversed image or a reversed or mirror image, as needed.

The sheet cassettes 26-1 and 26-2 each can be pulled out toward the front of the printer body for the replenishment or the replacement of sheets. In the printer shown in the right part of FIG. 25, the door 67 is opened while the sheet cassette 26-2 is pulled out.

A specific configuration of the printer including a plurality of first image carriers and a second image carrier movable into and out of contact with the first image carriers will be described hereinafter with reference to FIG. 26. Either one of the first and second embodiments described above may be applied to the configuration to be described.

Figure 26:
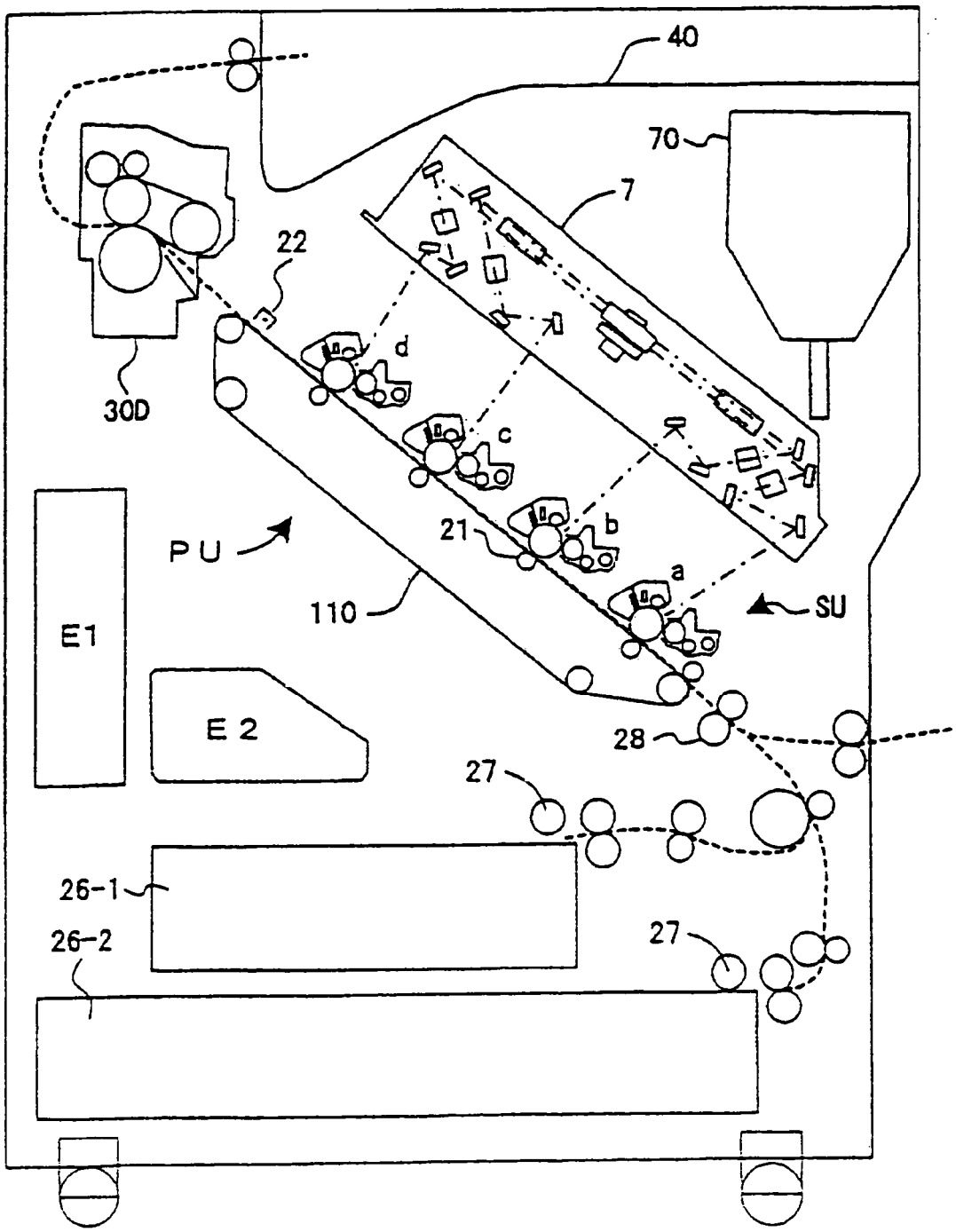
FIG. 26 is a view showing another specific configuration of the image forming apparatus in which a first image carrier is implemented as a plurality of image carriers.

As shown in FIG. 26, the image forming section PU capable of forming a full-color image is located at substantially the center of the printer. Four image forming units SU are arranged side by side along the upper run of the belt 110. The optical writing unit 7 is positioned above the image forming units SU. The image forming units SU are identical in configuration except for the color of toner. Each image forming unit SU is identical with the image forming unit shown in FIG. 15 except for the positional relation between the structural elements. In FIG. 26, a group of image carriers made up of the four image forming units SU (a through d) constitutes a first image carrier in combination. It is to be noted that the first image carrier, or group of image carriers, may include any desired number of image forming units. For example, the black image forming unit may be omitted or may be combined with the red and blue image forming units.

In FIG. 26, the developing device 5 of each image forming unit stores one of cyan, magenta, yellow and black toner and develops a latent image formed on the associated drum with the toner. In the monochromatic print mode, only the image forming unit assigned to black forms an image. In the specific configuration shown in FIG. 26, the image forming unit SU-d located at the highest level or most downstream position is assigned to black so as to prevent an image from being disturbed by the other image forming units.

Figure 27:
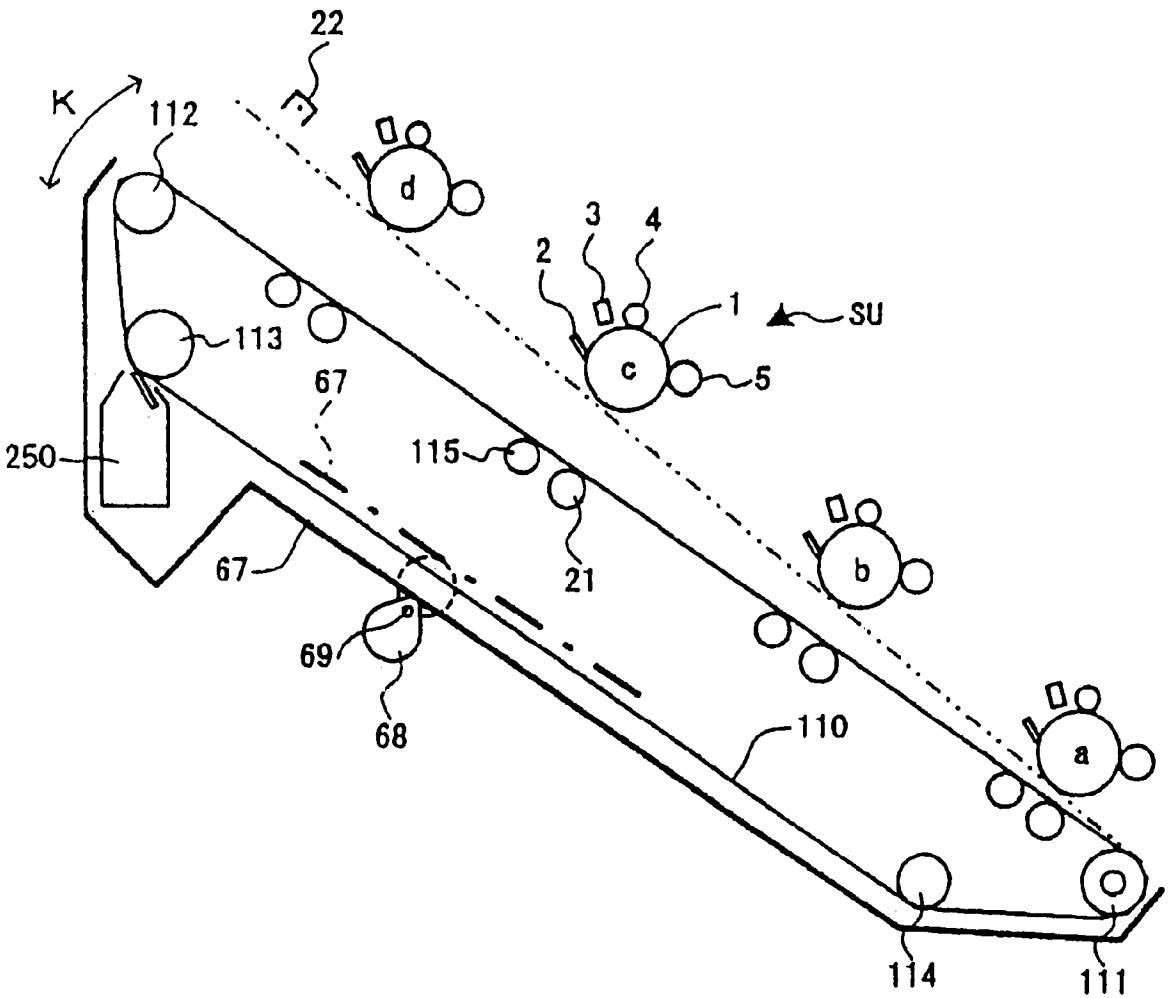
FIG. 27 is a section showing a second image carrier included in the apparatus of FIG. 26.

As shown in FIG. 27 in detail, the first image transferring means 21 are arranged in the loop of the belt 110 for transferring toner images from the drums 1 to the belt 110 or transferring them directly to the upper surface of a sheet. The second image transferring unit for transferring a toner image from the belt 110 to the lower surface of the sheet is implemented as the charger 22 located downstream of the image forming unit SU-d.

The belt or second image carrier is passed over the rollers 111 through 114 and movable counterclockwise, as viewed in FIG. 27. Devices arranged inside of the loop of the belt 110 are suitably grounded via the printer body. A belt cleaner 250 faces the belt 110 at a position where the driven roller 113 is located. A moving mechanism, which will be described later, causes the belt 110 to selectively move about the shaft of the roller 111 into or out of contact with the in a direction K into or out of contact with the image forming units SU or first image carrier.

As shown in FIG. 26, the two sheet cassettes 26-1 and 26-2 are stacked one above the other in the lower portion of the printer body. The pickup roller 27 associated with designated one of the sheet cassettes 26-1 and 26-2 pays out the top sheet from the cassette. Electric units E1 and E2 are located above the sheet cassette 26-1. A toner container 70 is positioned at the top right corner of the printer body. Toner is replenished from the toner container 70 to corresponding one of developing devices via a powder pump not shown. The top of the printer body constitutes the stack portion or print tray 40. A fixing device 30D is located downstream of the image forming unit SU-d assigned to black and uses a belt.

As shown in FIG. 27, the belt 110 is mounted on a unit frame 67 angularly movable about the shaft of the roller 111. An eccentric cam 68 is affixed to a shaft 69 and held in contact with the bottom of the frame 67. When the cam 68 is caused to rotate, it moves the unit frame 67 in the direction K with the result that the belt 110 is angularly moved into or out of contact with the image forming units SU. The belt 110 may be angularly moved about the roller 112, if desired.

Figure 28:
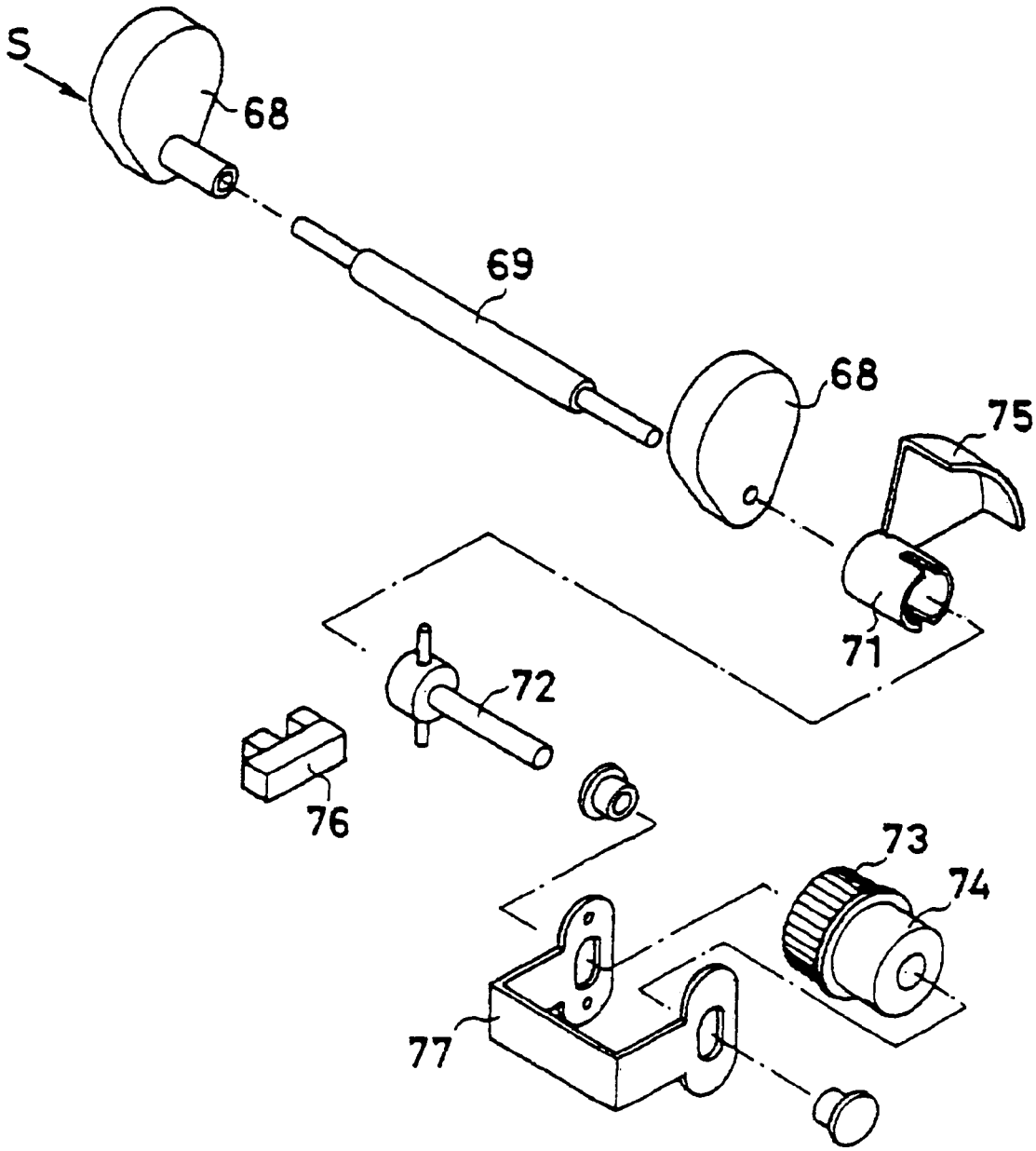
FIG. 28 is a fragmentary view showing a specific configuration of a mechanism for moving the second image carrier of FIG. 27 into and out of contact with the first image carrier.

More specifically, as shown in FIG. 28, two eccentric cams 68 are mounted on opposite ends of a shaft 69. A joint 71 is affixed to the outside surface of one of the cams 68 located at the rear side of the printer body. The joint 71 is configured to receive projections formed on one end of a shaft 72. A gear 73 is affixed to the other end of the shaft 72 and provided with a clutch 74. The clutch 74 is selectively coupled or uncoupled to establish or interrupt, respectively, drive transmission from a motor, not shown, to the gear 73. A photointerrupter 76 is so positioned as to sense a feeder portion 75 included in the joint 71.

When the motor rotates the gear 73 via the clutch 74, the shaft 69 and therefore the cams 68 are rotated via the shaft 72 and joint 71, raising or lowering the unit frame 67. At this instant, the photointerrupter 76 senses the feeler portion 75 of the joint 71 and therefore the position of the eccentric cams 68. The position of the belt 110 is controlled in accordance with the output of the photointerrupter 76.

In FIG. 27, the cams 68 in rotation cause the unit frame 67 to angularly move about the roller 111 in the direction K. Therefore, when each cam 68 is brought to a position indicated by a phantom line in FIG. 27, it raises the unit frame 67 and therefore the belt 110. Consequently, the upper run of the belt 110 contacts the four image forming units SU-e through SU-d, i.e., the drums 1, as indicated by a phantom line in FIG. 27. When the cam 68 is brought to a position indicated by a solid line in FIG. 27, the unit frame 67 and therefore the belt 110 is released from the image forming units SU-a through SU-d, as indicated by a solid line in FIG. 27.

In operation, in the full-color print mode, toner images formed in cyan, magenta, yellow and black on the drums 1 of the four image forming units or first image carrier SU are sequentially transferred to the belt 110 one above the other, completing a full-color image. In the monochromatic print mode, a black toner image is transferred from the image forming unit SU-d to the belt 110. In any case, such image transfer is effected by the image transfer rollers or first image transferring means 21. Of course, the belt or second image carrier 110 is held in contact with the drums 1 during image transfer.

In the duplex print mode, after the entire first toner image to be transferred to the first side of a sheet has been transferred to the belt 110, the belt 110 is released from the image forming units or first image carrier SU and then reversed to a preselected position. The distance of reverse movement is controlled on the basis of the number of steps of the stepping motor assigned to the belt 110. Again, the belt 110 is reversed at a speed two times as high as the speed of forward or usual movement. When the belt 110 reaches the preselected position, it is again brought into contact with the image forming units SU and caused to rotate forward, i.e., counterclockwise in FIG. 26 at the usual speed.

On the other hand, a second toner image to be transferred to the second side of the same sheet is formed by the image forming units SU. At the same time, a sheet is fed from designated one of the sheet cassettes 26-1 and 26-2 toward the registration roller pair by the pickup roller 27. The second toner image is transferred from the image forming units SU to the second side of the sheet. In the monochromatic print mode, a black toner image is transferred from the image forming unit SU-d to the sheet. In any case, the image transfer is effected by the image transfer rollers 21 disposed in the loop of the belt 110. At this time, the first toner image on the belt 110 has already been returned to the preselected position and is therefore overlaid on the first side of the sheet. While the sheet carrying the two images on both sides thereof is conveyed upward by the belt 110, the charger or second image transferring means 22 transfers the first toner image from the belt 110 to the first side of the sheet.

As stated above, after one page of toner image has been transferred to the belt 110 in the duplex print mode, the belt 110 is reversed at the higher speed for thereby enhancing productivity.

In the simplex print mode, toner images are directly transferred from the image forming units SU to a sheet being conveyed by the belt 110 one above the other. To print an image on the lower side of a sheet, it suffices to transfer a toner image to the lower side of a sheet by way of the belt 110 by use of the charger or second image transferring means 22. In this case, the reverse movement of the belt 110 effected at high speed enhances productivity.

Again, it is rather desirable to cause the belt 10 to simply complete one turn than to move it in the reverse direction, depending on the image size. For example, assume that the maximum image size that can be transferred to the belt 10 is the A3 profile size. Then, the belt 10 is reversed for an image size smaller than the A4 landscape size or continuously moved forward by one turn for an image of the A4 landscape size or above. In any case, such control over the belt 10 prevents productivity from being lowered when the image size is large or improves productivity when the image size is small.

The configuration of FIG. 27 including four image forming units arranged side by side reduces a period of time necessary for forming a full-color image, compared to the configuration that causes a single drum to make four full rotations. This, coupled with enhanced productivity implemented by the first or the second embodiment varying the belt running condition, realizes a printer achieving a remarkable improvement in productivity in the full-color duplex print mode.

The configuration of FIG. 27 may also include the polarity switching means 50 shown in FIGS. 6A through 6F, 7A through 7F or 10A through 10F. This allows a single image transferring means 21 to transfer images to both sides of a sheet although the image transferring means should be assigned to each image forming unit.

Further, the fixing device of FIG. 3 using a heat roller may be positioned outside of the loop of the belt 110 or the fixing device of FIG. 1 or 2 may be positioned inside of the loop of the belt 110. In addition, the first image transferring means 21 may be implemented as a charger, if desired.

In any one of the illustrative embodiments shown and described, the speed of reverse movement of the belt is not limited to a speed two times as high as the usual speed, but may be a speed that is any suitable multiple of the usual speed. The distance of reverse movement of the belt may be controlled on the basis of the output of an encoder mounted on, e.g., the output shaft of a servo motor in place of the number of steps of a stepping motor.

The reference image sized used to selectively reverse the belt is not limited to A4, but may be suitably selected in accordance with the circumferential length, conveyance speed and speed of reverse movement of the belt as well as the configurations of the various devices. The moving mechanism for selectively moving the first and second image carriers into or out of contact with each other is open to choice. This is also true with the mechanism for correcting the offset of the belt. The offset correcting mechanism may be applied to the belt or second image carrier 110 shown in any one of FIGS. 14, 22, 24 and 26 as well.

The drum may be replaced with a photoconductive belt in any one of the configurations shown in FIGS. 1, 2, 3, 4 and 26 as well. The polarities of the drum, toner, image transfer voltage and so forth are only illustrative and may be reversed each.

The optical writing unit 7 may use an LED array in place of the laser optics or may even use an analog exposing system. In the case of an analog exposing system, a non-reversed image can be formed on the photoconductive element if a mirror is used.

Further, the configurations of the charging means, developing device, first and second image transferring devices, polarity switching device and fixing device shown and described are only illustrative. Of course, the present invention may be implemented as a copier or a facsimile apparatus, if desired.

In summary, it will be seen that the present invention provides an image forming apparatus having various unprecedented advantages, as enumerated below.

(1) Productivity is enhanced in both of the simplex and duplex print modes. Particularly, higher productivity is achievable at low cost in the full-color duplex print mode.

(2) Images can be surely transferred to both sides of a sheet at the same time.

(3) Drive means assigned to a second image carrier is independent of drive means assigned to a first image carrier, allowing the running condition of the second image carrier to be easily controlled.

(4) When the running condition of the second image carrier is varied, the second image carrier can be accurately controlled, enhancing image quality.

(5) Productivity is prevented from falling when image size is relatively large.

(6) An image is free from disturbance during fixation and therefore high quality.

(7) Jam processing and maintenance are easy to perform.

Various modifications will become possible for those skilled in the art after receiving the teachings of the present disclosure without departing from the scope thereof.

What is claimed is:

1. An image forming apparatus, comprising:

a main body;

a plurality of developer containing members disposed in the main body with at least two of the plurality of developer containing members being positioned to have a portion thereof at a different height in the main body and with none of the plurality of developer containing members having any portion thereof in vertical alignment in the main body; and at least one cover, connected to the main body, which provides access to at least one of the plurality of developer containing members through at least one opening in the main body provided when the at least one cover is in an open position.

2. The image forming apparatus as claimed in claim 1, wherein the at least one cover is disposed at an angle, and wherein the plurality of developer containing members are each disposed along a direction substantially parallel to a plane occupied by the at least one cover when the at least one cover is in a closed position and said at least one opening simultaneously exposes each of the developer containing members in the main body.

3. The image forming apparatus as claimed in claim 1, wherein the plurality of developer containing members are disposed in an uppermost portion of the main body adjacent the at least one cover when the at least one cover is in a closed position.

4. The image forming apparatus as claimed in claim 1, further comprising a discharging unit disposed in the main body, wherein an image-formed recording medium is discharged through the discharging unit to the at least one cover, and wherein the developer containing member that is most distant from the discharging unit is positioned at a same height as the discharging unit.

5. The image forming apparatus as claimed in claim 1, wherein the plurality of developer containing members comprises at least three developer containing members each configured to hold a developer of a different color.

6. The image forming apparatus as claimed in claim 1, wherein when the at least one cover is in the open position, the plurality of developer containing members are all accessible for replacement through the at least one opening.

7. The image forming apparatus as claimed in claim 1, wherein the at least one cover is configured to receive a recording medium having an image formed thereon by the image forming apparatus.

8. The image forming apparatus as claimed in claim 1, wherein the at least one cover is configured to pivot on a shaft such that the at least one top cover receives a recording medium having an image formed thereon by the image forming apparatus when the at least one top cover is opened and when the at least one top cover is closed.

9. The image forming apparatus as claimed in claim 1, further comprising:

a belt disposed below the plurality of developer containing members.

10. The image forming apparatus as claimed in claim 9, wherein the belt is configured to receive at least one image and to transfer the image to a recording medium.

11. An image forming apparatus, comprising:

a main body;

a plurality of means for containing developer, the plurality of means being disposed in the main body at different heights; and a cover, connected to the main body, which provides access to each of the plurality of means through an opening provided when the cover is in an open position, said opening providing simultaneous exposure of each of the plurality of means.

12. The image forming apparatus as claimed in claim 11, wherein the cover is disposed at an angle, and wherein the plurality of means are each disposed along a direction substantially parallel to a plane occupied by the cover when the cover is in a closed position.

13. The image forming apparatus as claimed in claim 11, wherein the plural means for containing developer are disposed in an uppermost portion of the main body adjacent to the cover when the cover is in a closed position.

14. The image forming apparatus as claimed in claim 11, further comprising means for discharging an image-formed recording medium to the cover, wherein the plurality of means comprises a first means and a second means for containing developer and the first means is disposed a greater distance from the means for discharging than the second means and is disposed at a same height as the means for discharging.

15. The image forming apparatus as claimed in claim 11, wherein the plurality of means each contain a developer of a different color.

16. The image forming apparatus as claimed in claim 11, wherein when the cover is in the open position, the plurality of means are all accessible for replacement through the opening.

17. The image forming apparatus according to claim 11, wherein the plurality of means for containing developer include a first, second, third, and fourth means for containing developer, wherein each of the first, second, third, and fourth means contain a developer of a different color.

18. The image forming apparatus as claimed in claim 11, wherein the top cover is configured to receive a recording medium having an image formed thereon by the image forming apparatus.

19. The image forming apparatus as claimed in claim 11, wherein the cover is configured to pivot on a shaft such that the cover receives a recording medium having an image formed thereon by the image forming apparatus when the cover is opened and when the cover is closed.

20. The image forming apparatus as claimed in claim 11, further comprising:

a belt disposed below the plurality of means.

21. The image forming apparatus as claimed in claim 20, wherein the belt is configured to receive at least one image and to transfer the image to a recording medium.

22. An image forming apparatus, comprising:

a main body;

a plurality of developer containing members disposed in the main body with at least two of the plurality of developer containing members being positioned to have a portion thereof at a different height in the main body; and at least one cover, connected to the main body, which provides direct access to each of the plurality of developer containing members through at least one opening in the main body when the at least one cover is in an open position, said at least one opening simultaneously exposing the plurality of developer containing members in the main body.

23. An image forming apparatus, comprising:

a main body;

a plurality of means for containing developer, the plurality of means being disposed in the main body with at least two of the plurality of means being positioned to have a portion thereof at a different height in the main body and with none of the plurality of means having any portion thereof in vertical alignment in the main body; and at least one cover, connected to the main body, which provides access to at least one of the plurality of means through at least one opening in the main body provided when the at least one cover is in an open position.

24. An image forming apparatus, comprising:

a main body;

a plurality of means for containing developer, the plurality of means being disposed in the main body with at least two of the plurality of means being positioned to have a portion thereof at a different height in the main body; and at least one cover, connected to the main body, which provides direct access to each of the plurality of means through at least one opening in the main body when the at least one cover is in an open position, said at least one opening simultaneously exposing the plurality of means in the main body.

* * * * *